US011363889B2

(12) United States Patent
Thomas

(10) Patent No.: US 11,363,889 B2
(45) Date of Patent: Jun. 21, 2022

(54) PHYSIOLOGICAL SEAT DEVICE

(71) Applicant: Hervé Thomas, Montreal (CA)

(72) Inventor: Hervé Thomas, Montreal (CA)

(73) Assignee: 9442-8851 Quebec Inc., Mirabel (CA)

( * ) Notice: Subject to any disclaimer, the term of this patent is extended or adjusted under 35 U.S.C. 154(b) by 0 days.

(21) Appl. No.: 16/972,542

(22) PCT Filed: Jun. 6, 2019

(86) PCT No.: PCT/IB2019/054731
§ 371 (c)(1),
(2) Date: Dec. 4, 2020

(87) PCT Pub. No.: WO2019/234683
PCT Pub. Date: Dec. 12, 2019

(65) Prior Publication Data

US 2021/0235873 A1 Aug. 5, 2021

(30) Foreign Application Priority Data

Jun. 6, 2018 (FR) ..... 18/70658

(51) Int. Cl.

| | |
|---|---|
| ***A47C 1/03*** | (2006.01) |
| ***A47C 7/02*** | (2006.01) |
| ***A47C 7/40*** | (2006.01) |
| ***A47C 7/44*** | (2006.01) |

(Continued)

(52) U.S. Cl.
CPC ..... *A47C 7/441* (2013.01); *A47C 7/46* (2013.01); *A47C 7/563* (2013.01); *A47C 7/444* (2018.08)

(58) Field of Classification Search
CPC .. A47C 7/14; A47C 7/441; A47C 7/46; A47C 7/563
USPC ..... 297/195.1, 15.11, 284.4, 285, 296, 297, 297/298, 312, 195.11
See application file for complete search history.

(56) References Cited

U.S. PATENT DOCUMENTS 635,234 A * 10/1899 Chance ..... A47C 3/0255 297/195.11 X
4,489,982 A * 12/1984 Morrow ..... A47C 7/46 297/284.4

(Continued)

FOREIGN PATENT DOCUMENTS

| | | |
|---|---|---|
| DE | 29711329 U1 | 6/2007 |
| EP | 2172135 B1 | 7/2013 |
| FR | 2985902 B1 | 4/2015 |

OTHER PUBLICATIONS

Aug. 16, 2019, PCT/IB2019/054731, International Search Report, (3 pgs).

(Continued)

*Primary Examiner* — Rodney B White
(74) *Attorney, Agent, or Firm* — Matthew D. Thayne; Thayne and Davis LLC

(57) ABSTRACT

This disclosure relates to a seat device (1) comprising an underframe (2) and a seat (3) connected to the underframe (2) in such a way as to pivot about a pivot seat axis (A1), there being provided means for elastically biasing the seat (3) in anti-clockwise rotation. The seat device (1) further comprises a lumbar part (42); rotationally secured to the seat (3), and a saddle (5) for supporting the top of the thighs of the user, the saddle (5) being connected to the front region of the seat (3).

20 Claims, 40 Drawing Sheets

(51) Int. Cl.
*A47C 7/46* (2006.01)
*A47C 7/56* (2006.01)

(56) References Cited

U.S. PATENT DOCUMENTS 4,552,404 A * 11/1985 Congleton ..... A47C 7/029 297/330
5,249,839 A * 10/1993 Faiks ..... A47C 1/03255 297/284.4 X
5,501,507 A * 3/1996 Hummitzsch ..... A47C 7/405 297/284.4
5,630,648 A * 5/1997 Allard ..... A47C 9/025 297/313 X
5,873,628 A * 2/1999 Allard ..... A47C 9/025 297/326
6,203,107 B1 * 3/2001 Jonsson ..... A47C 1/023 297/312 X
6,626,494 B2 * 9/2003 Yoo ..... A47C 7/46 297/284.4
7,090,303 B2 * 8/2006 Kropa ..... A47C 7/024 297/312 X
7,252,336 B2 * 8/2007 Frisina ..... B60N 2/1839 297/313 X
7,293,825 B2 * 11/2007 Vergara ..... A47C 9/002 297/313 X
7,396,082 B2 * 7/2008 Sanchez ..... A47C 7/405 297/284.4
7,625,046 B2 * 12/2009 Sanchez ..... A47C 7/402 297/284.4 X
8,100,476 B2 * 1/2012 Jenkins ..... A47C 3/18 297/284.4 X
8,308,240 B1 * 11/2012 Chou ..... A47C 7/462 297/284.4
8,696,064 B2 * 4/2014 Pan ..... A47C 7/444 297/284.4 X
9,399,517 B2 * 7/2016 Guering ..... B60N 2/163
9,480,340 B1 * 11/2016 Harlow ..... A47C 7/441
11,116,319 B1 * 9/2021 Hsiao ..... A47C 7/024
2002/0180248 A1 * 12/2002 Kinoshita ..... A47C 7/46 297/284.1
2003/0055365 A1 * 3/2003 Hazard ..... A47C 9/002 601/98
2003/0107250 A1 * 6/2003 Staarink ..... A47C 7/402 297/284.7
2003/0137173 A1 * 7/2003 Kinoshita ..... A47C 1/03283 297/300.3
2003/0197407 A1 * 10/2003 Sanchez ..... A47C 7/405 297/353
2005/0046258 A1 * 3/2005 Sanchez ..... A47C 1/0244 297/353
2005/0168030 A1 * 8/2005 Bykov ..... A47C 7/14 297/312
2005/0184570 A1 * 8/2005 Sanchez ..... A47C 7/446 297/300.3
2006/0152053 A1 * 7/2006 Kim ..... A47C 7/024 297/312
2006/0175884 A1 * 8/2006 Jenkins ..... A47C 7/445 297/300.4
2007/0222265 A1 9/2007 Machael et al.
2007/0236066 A1 * 10/2007 Sanchez ..... A47C 7/46 297/353
2008/0018154 A1 * 1/2008 Chou ..... A47C 1/026 297/284.4
2008/0265641 A1 * 10/2008 Kim ..... A47C 7/024 297/312
2009/0146476 A1 * 6/2009 Kan ..... A47C 1/03255 297/284.4
2010/0259082 A1 * 10/2010 Votteler ..... A47C 1/03294 297/285
2013/0057038 A1 * 3/2013 Gloeckl ..... A47C 9/002 297/312
2013/0175839 A1 * 7/2013 Park ..... A47C 1/023 297/313
2014/0132051 A1 * 5/2014 Freedman ..... A47C 7/14 297/312
2014/0159444 A1 * 6/2014 Guering ..... B60N 2/77 297/195.11
2015/0015042 A1 * 1/2015 Willingham ..... A47C 7/029 297/284.7
2015/0102647 A1 * 4/2015 Grove ..... A47C 7/46 297/284.4
2015/0173515 A1 * 6/2015 Freedman ..... A47C 7/405 297/314
2018/0078812 A1 * 3/2018 Harlow ..... A63B 21/1609
2018/0235377 A1 * 8/2018 Choi ..... A47C 7/024
2019/0200763 A1 * 7/2019 Ehrenleitner ..... A47C 7/14
2020/0022497 A1 * 1/2020 Seo ..... A47C 7/46
2020/0383485 A1 * 12/2020 Snyder ..... A47C 7/14

OTHER PUBLICATIONS

Aug. 16, 2019, PCT/IB2019/054731, Written Opinion, (5 pgs).
Aug. 16, 2019, PCT/IB2019/054731, International Search Report, Human Translation, (4 pgs).
Aug. 16, 2019, PCT/IB2019/054731, Written Opinion, Human Translation, (4 pgs).

* cited by examiner

[Fig. 1A]
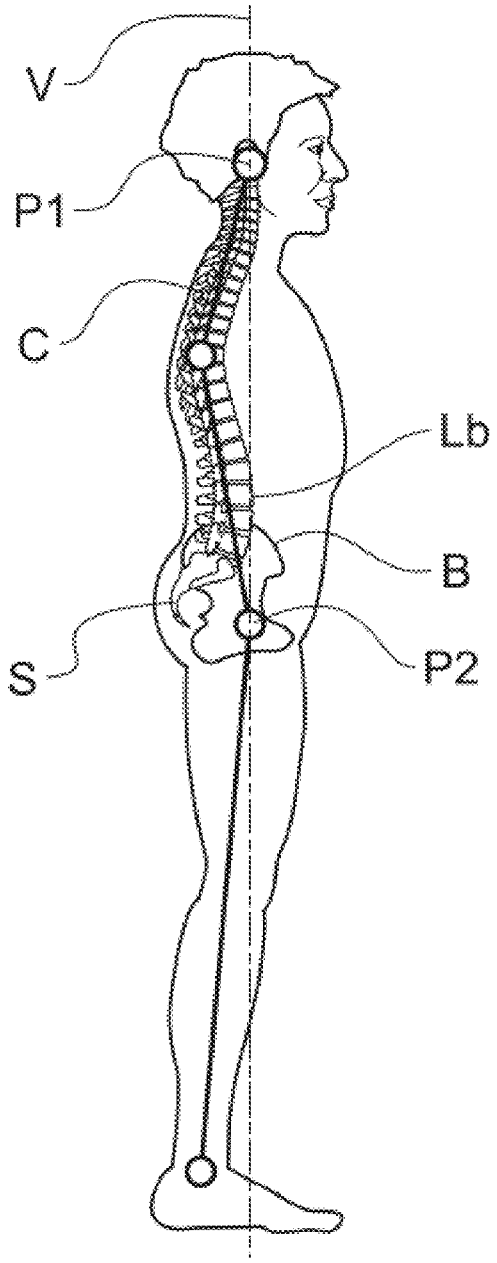

[Fig. 1B]
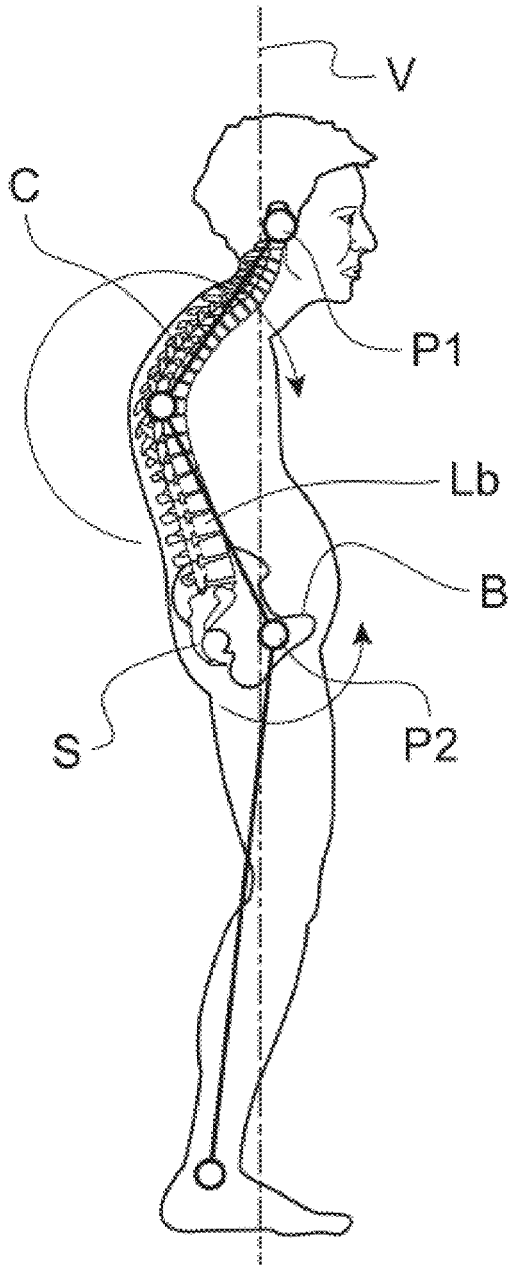

[Fig. 2A]
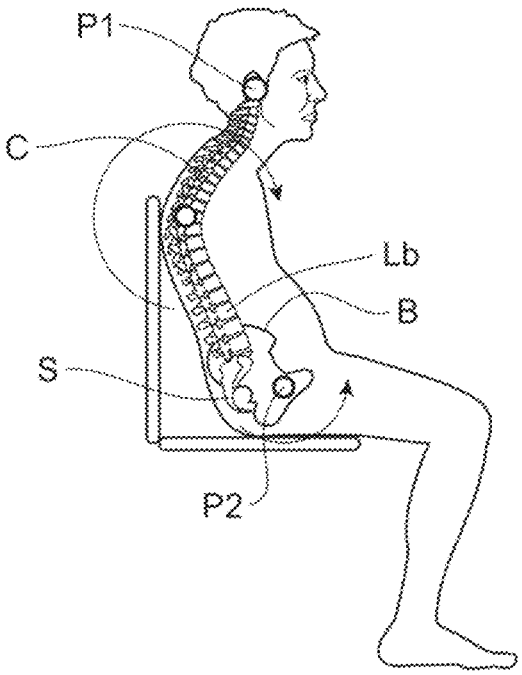
[Fig. 2B]
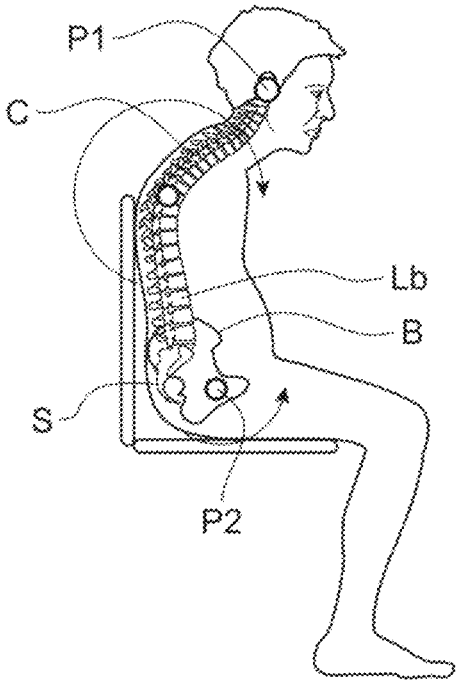

[Fig. 3]
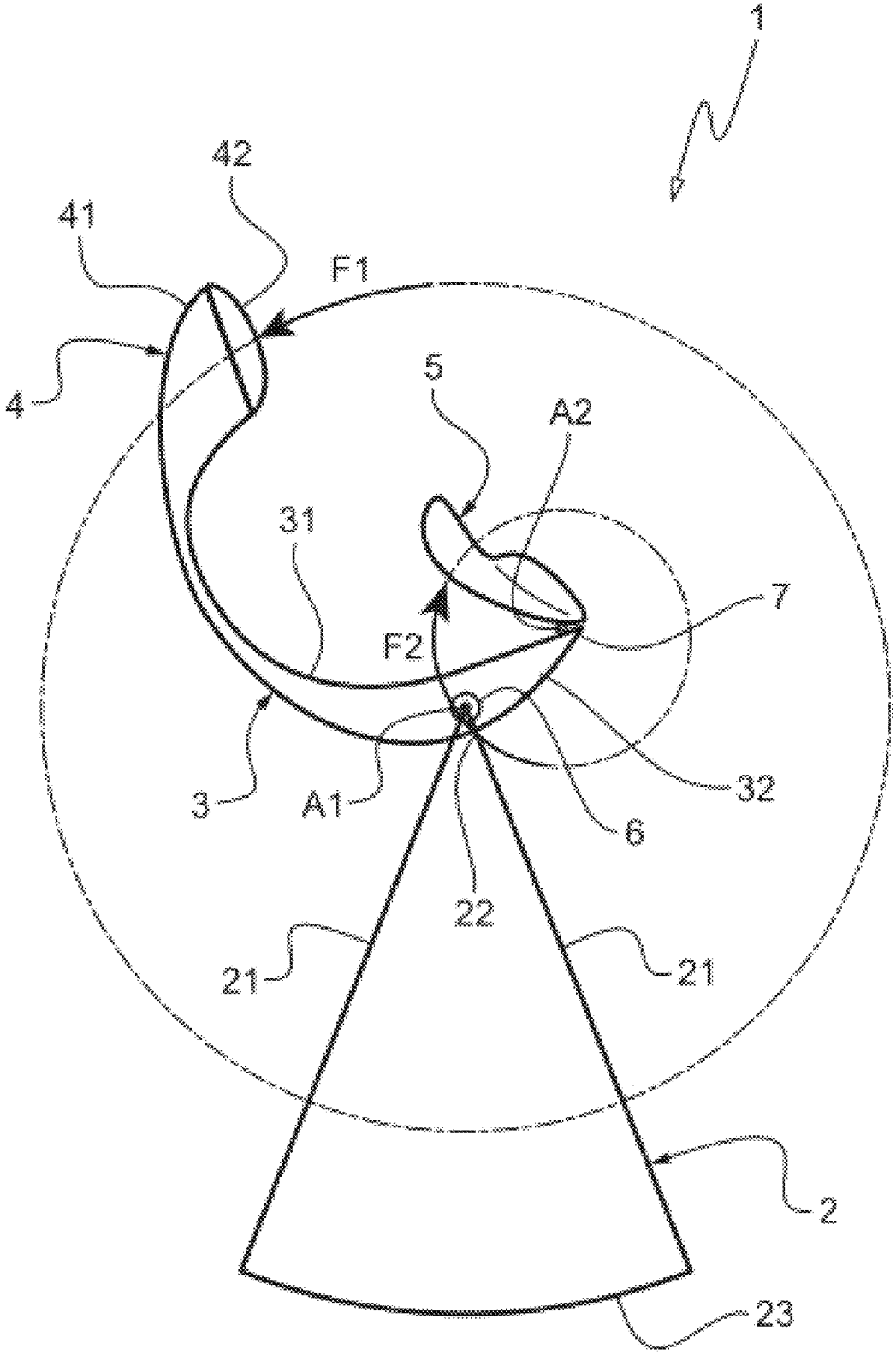

[Fig. 4A]
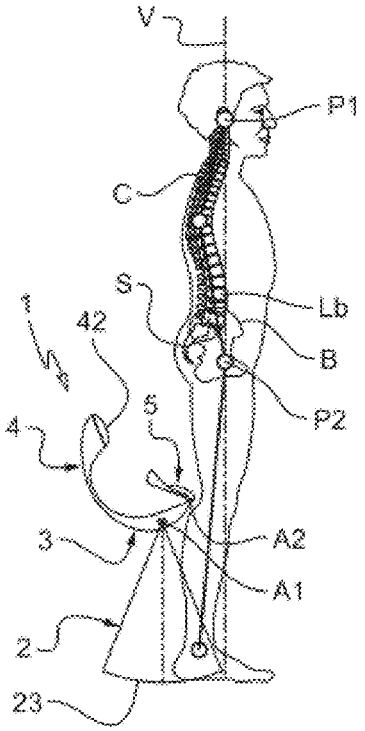
[Fig. 4B]
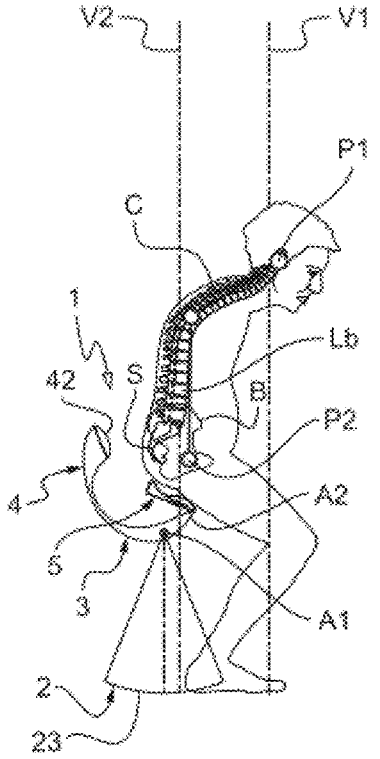

[Fig. 4C]
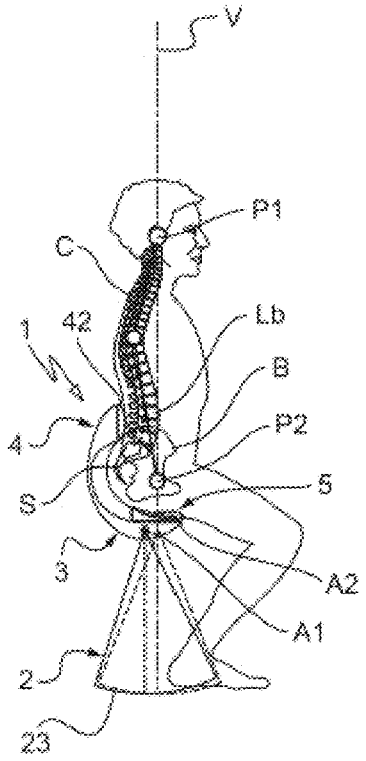
[Fig. 4D]
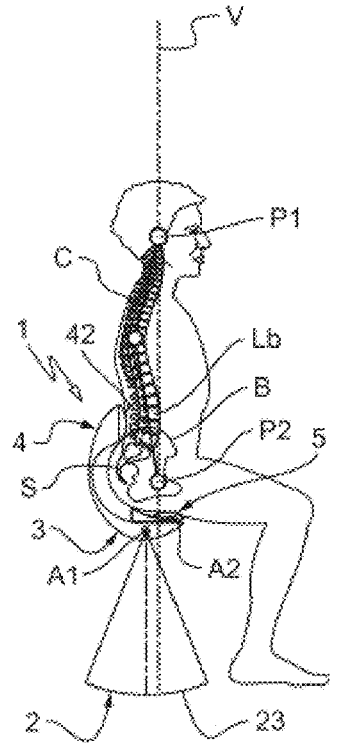

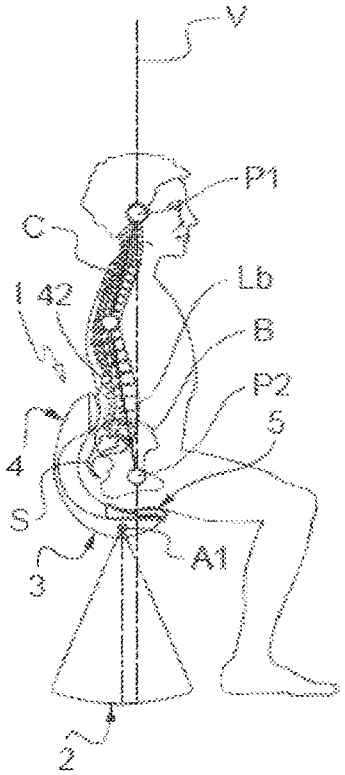
[Fig. 5A]

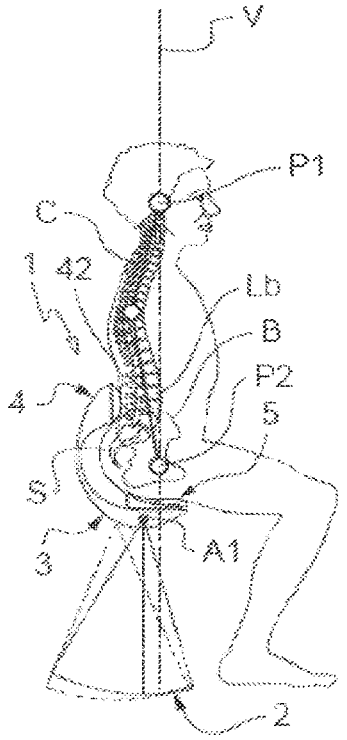
[Fig. 5B]
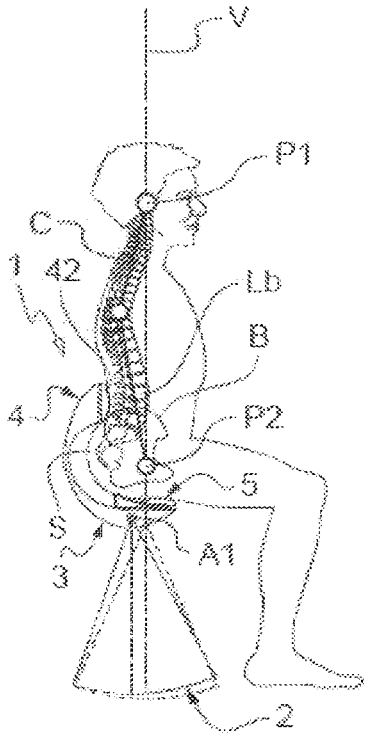
[Fig. 5C]

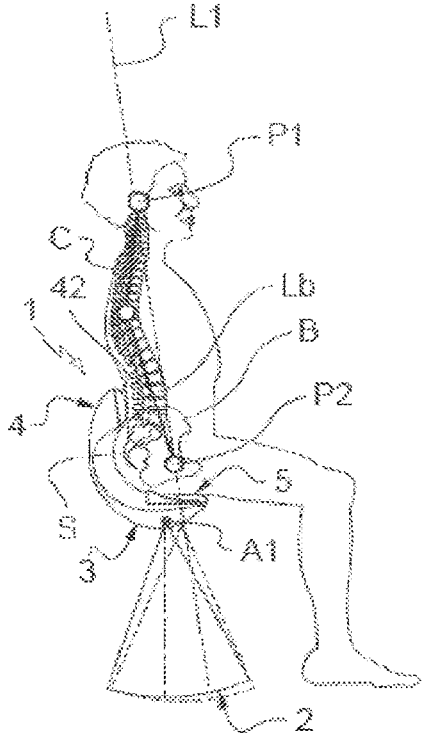
[Fig. 5D]
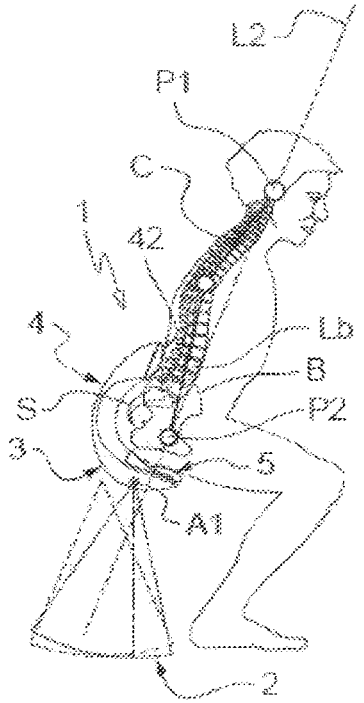
[Fig. 5E]

[Fig. 6]
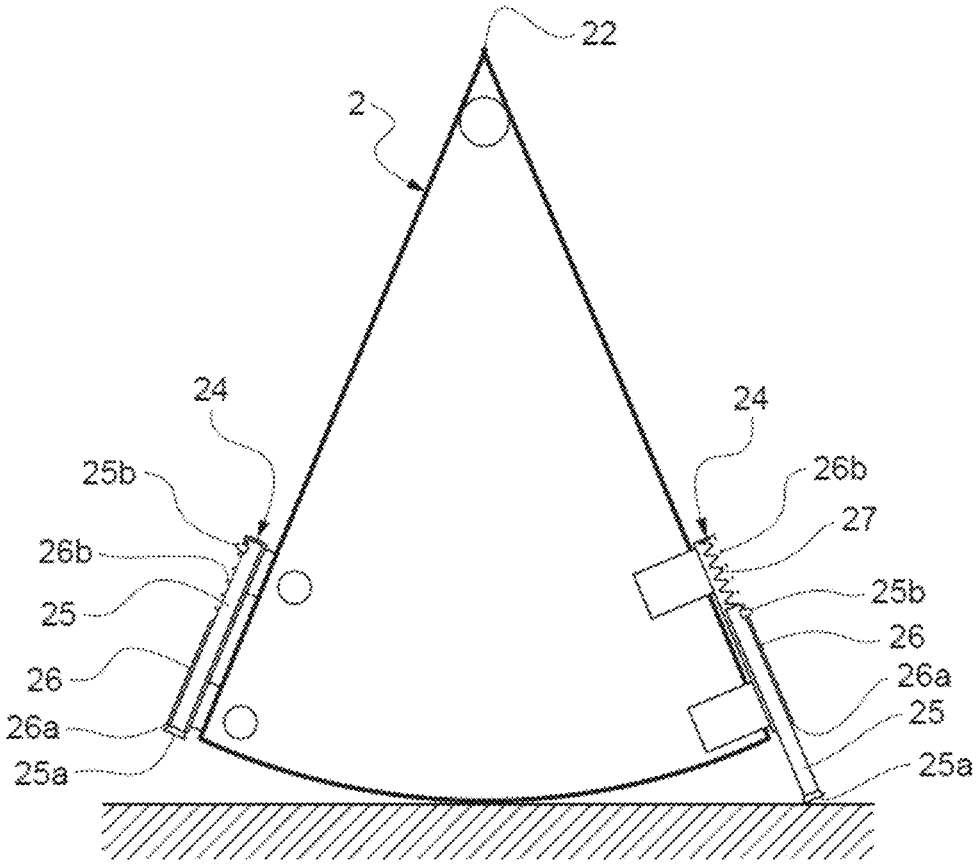
[Fig. 7A]
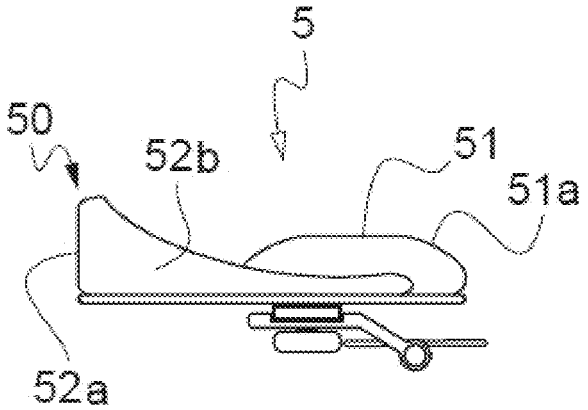

[Fig. 7B]
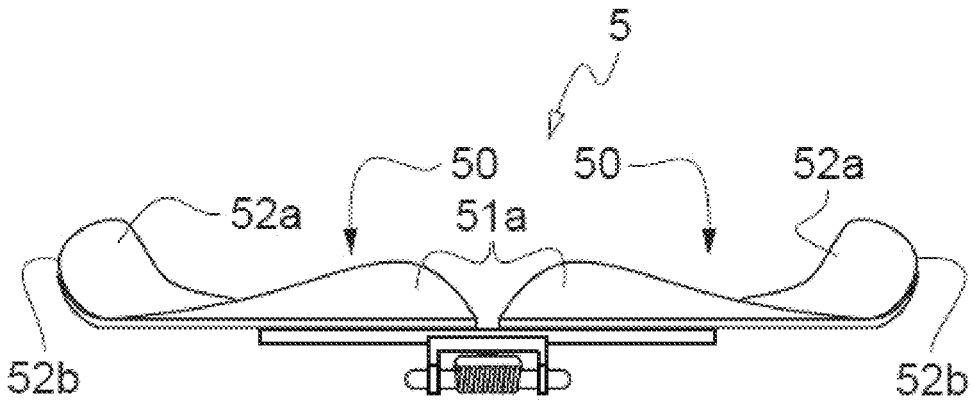
[Fig. 7C]
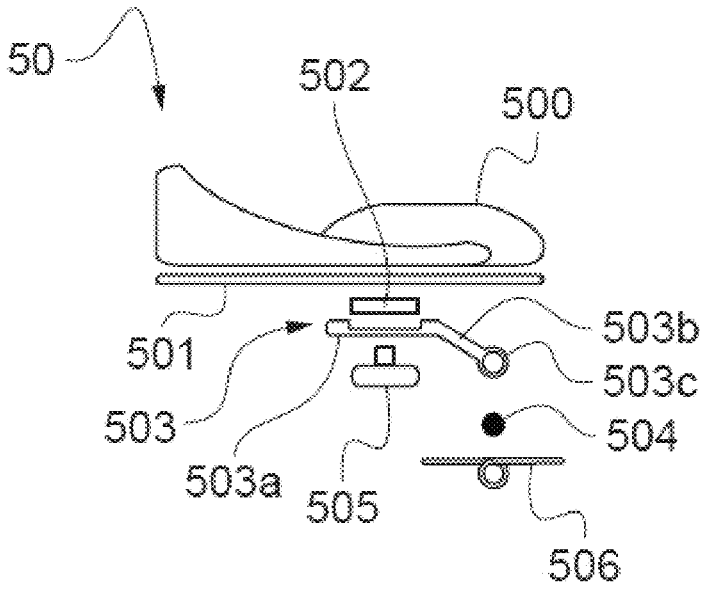

[Fig. 7D]
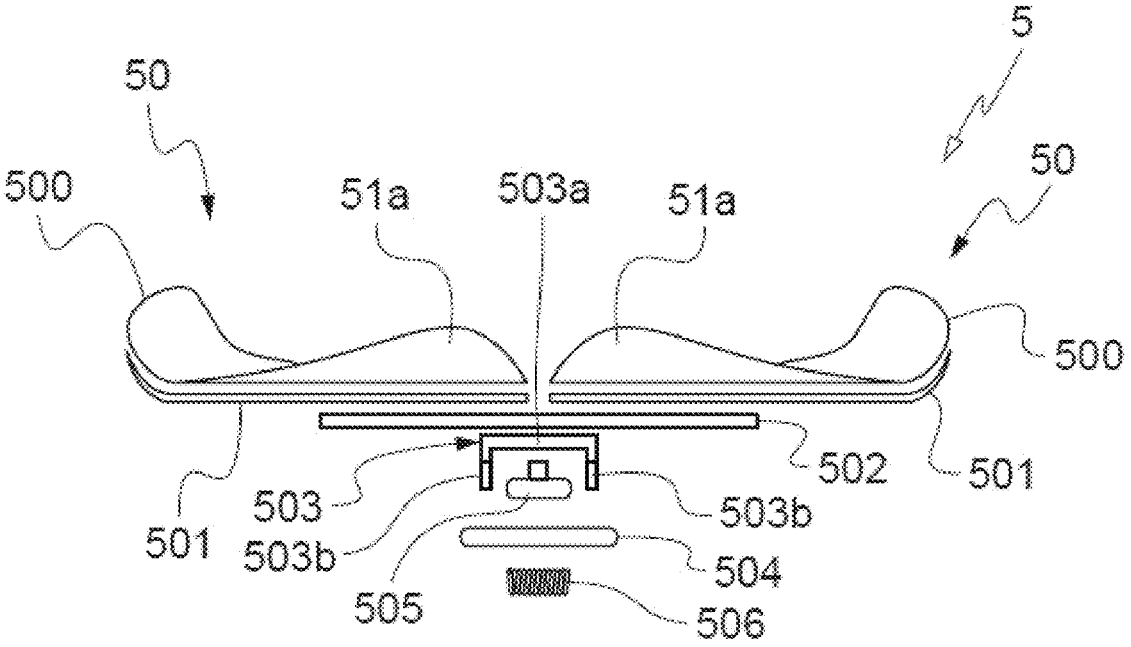
[Fig. 7E]
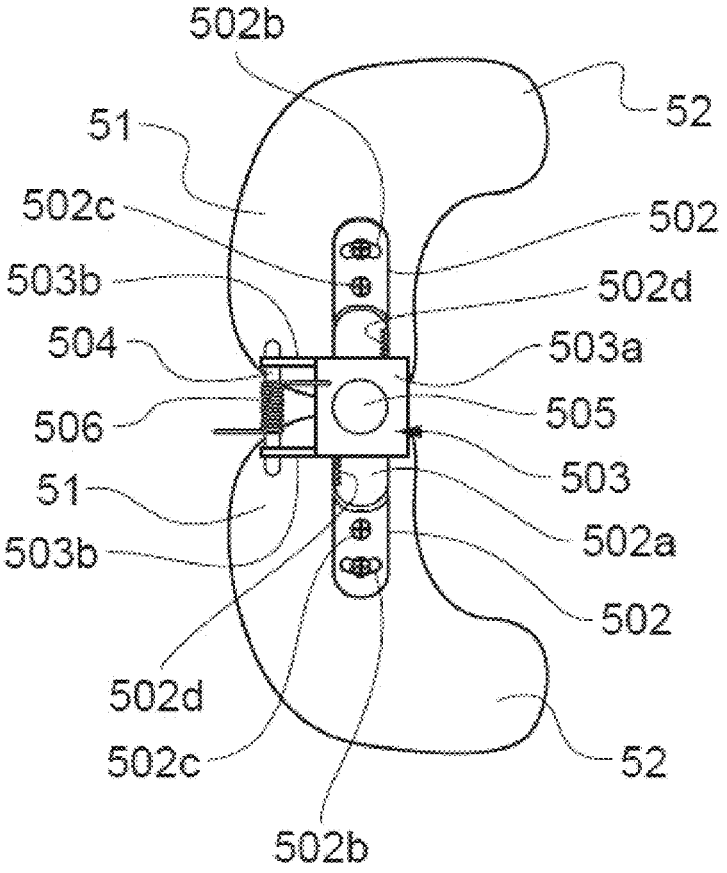

[Fig. 8A]
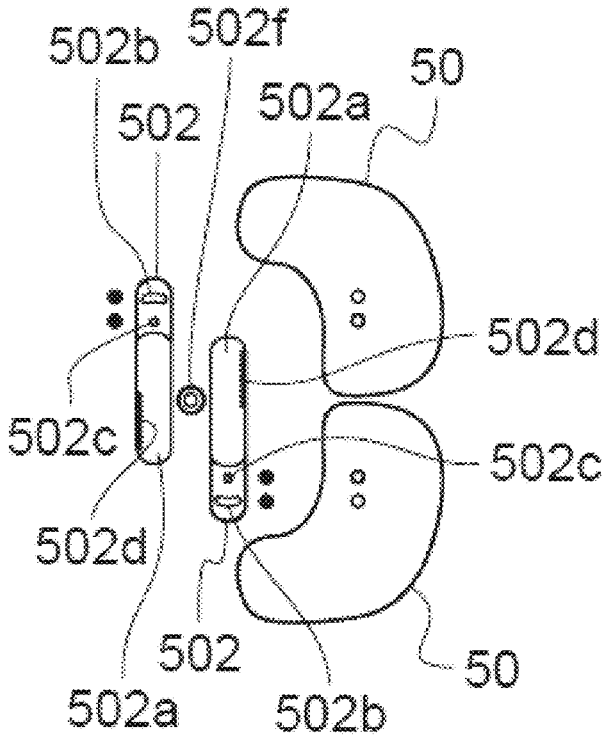
[Fig. 8B]
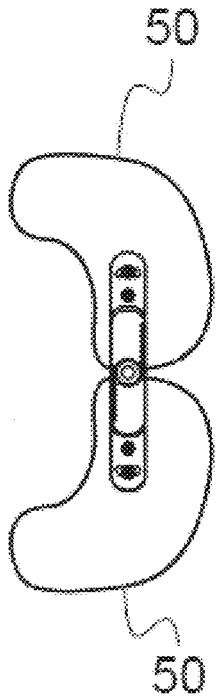

[Fig. 8C]
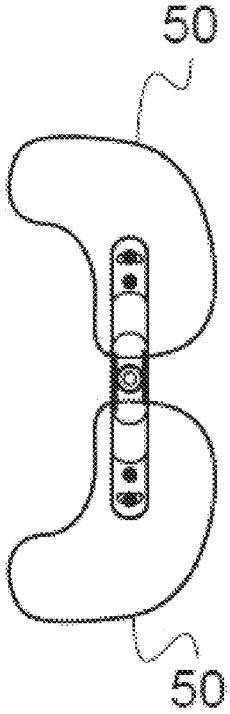
[Fig. 8D]
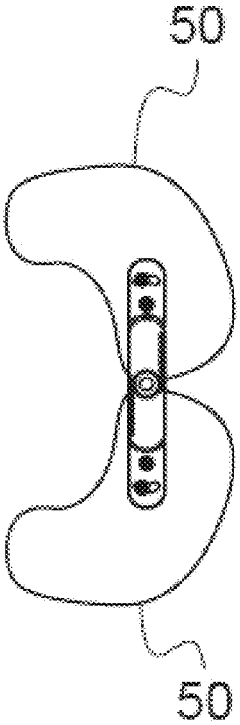

[Fig. 8E]
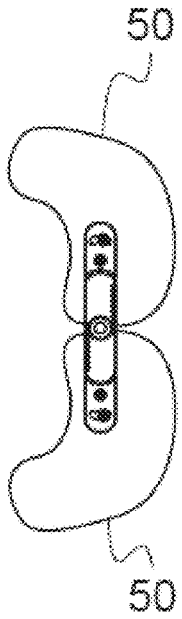
[Fig. 9A]
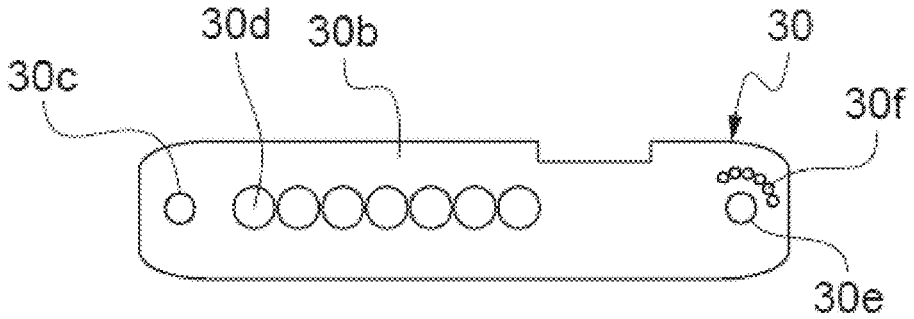
[Fig. 9B]
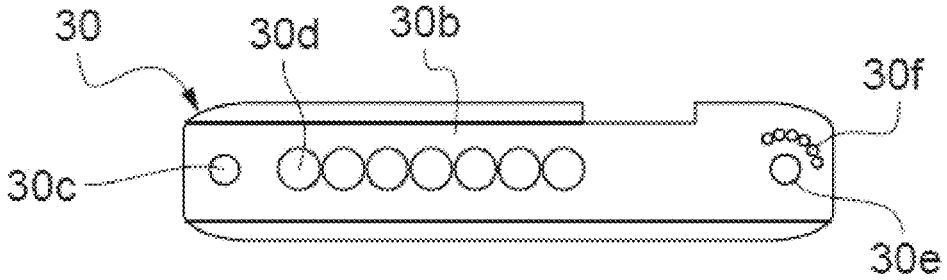

[Fig. 9C]
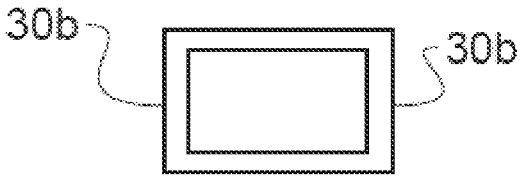
[Fig. 9D]
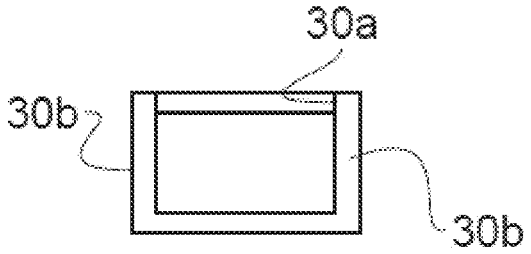
[Fig. 9E]
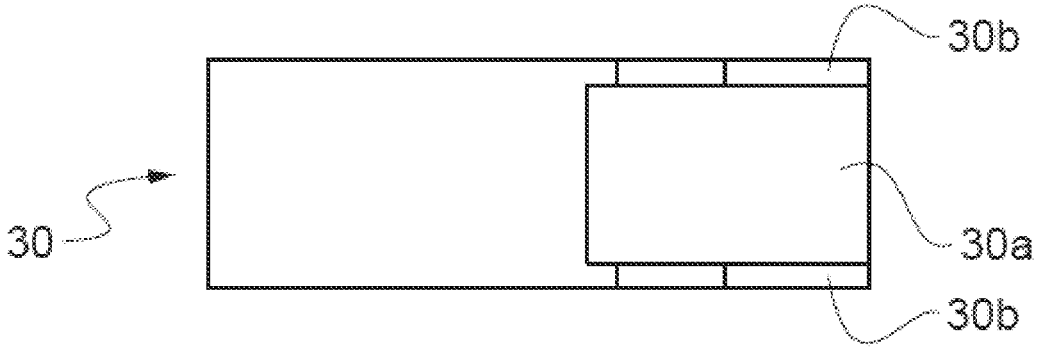

[Fig. 9F]
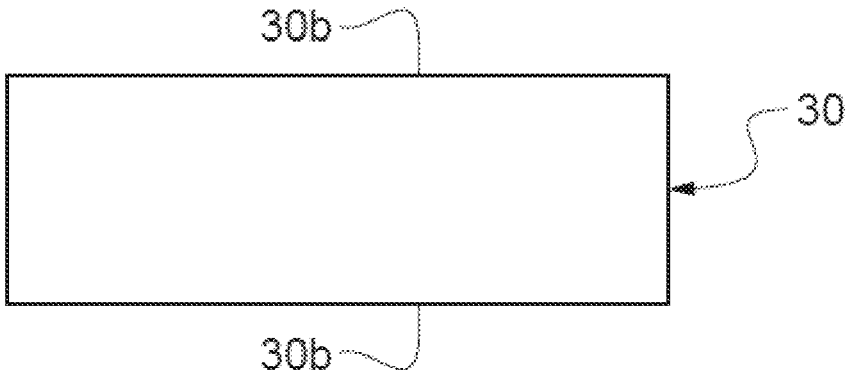
[Fig. 10A]
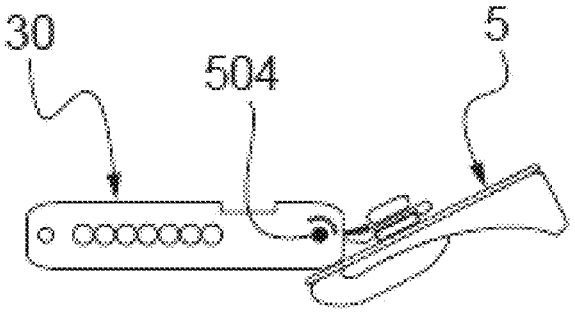
[Fig. 10B]
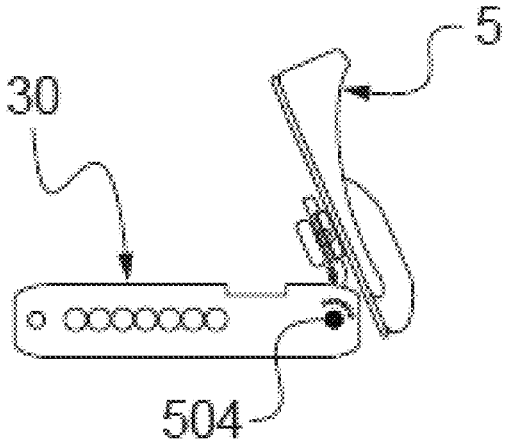

[Fig. 10C]
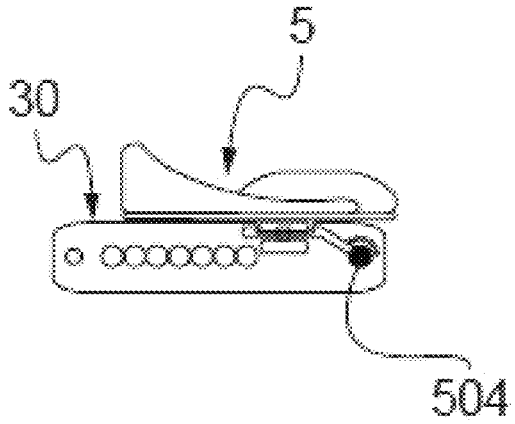
[Fig. 10D]
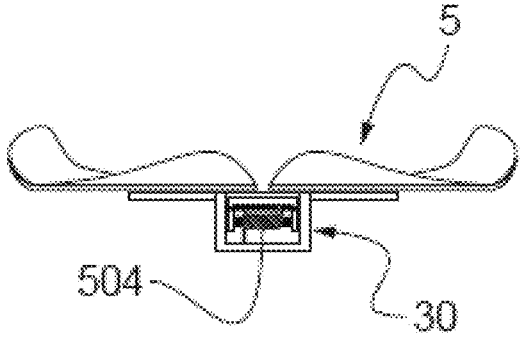
[Fig. 11A]
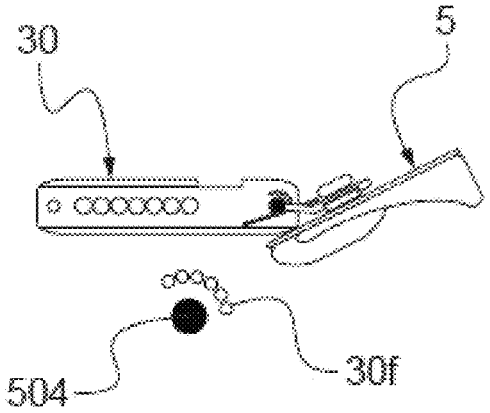

[Fig. 11B]
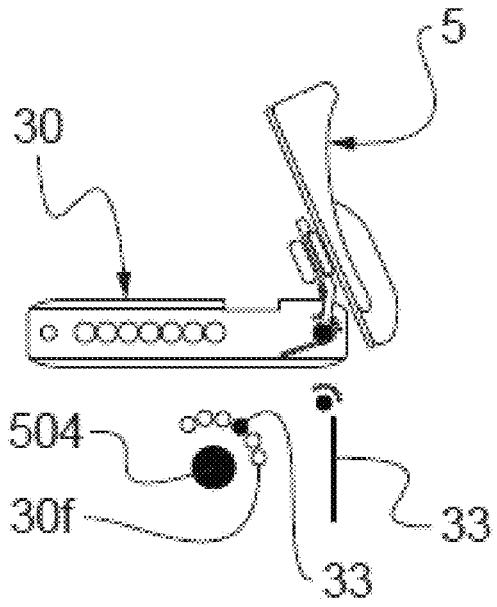
[Fig. 11C]
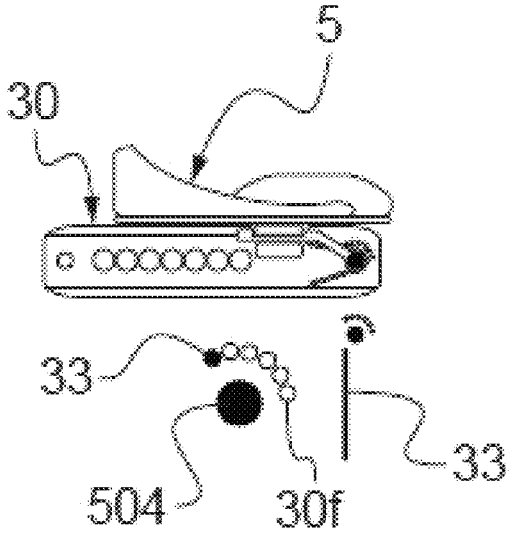

[Fig. 11D]
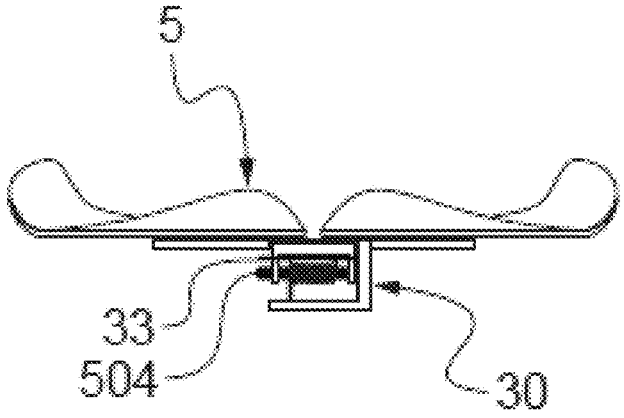
[Fig. 12A]
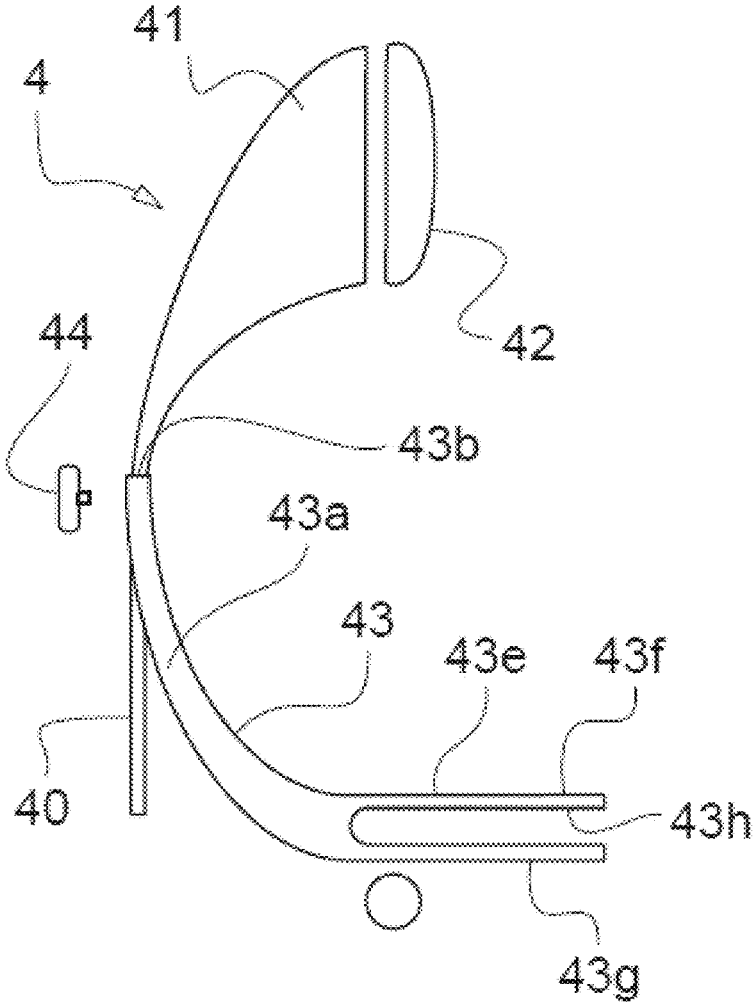

[Fig. 12B]
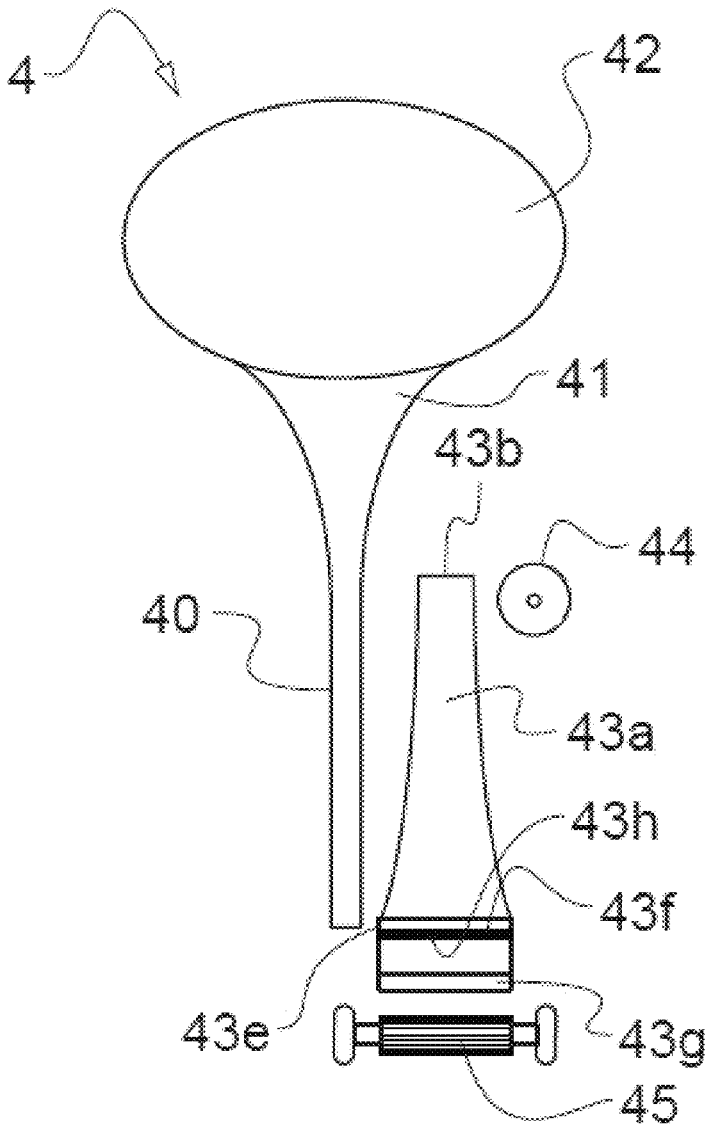

[Fig. 12C]
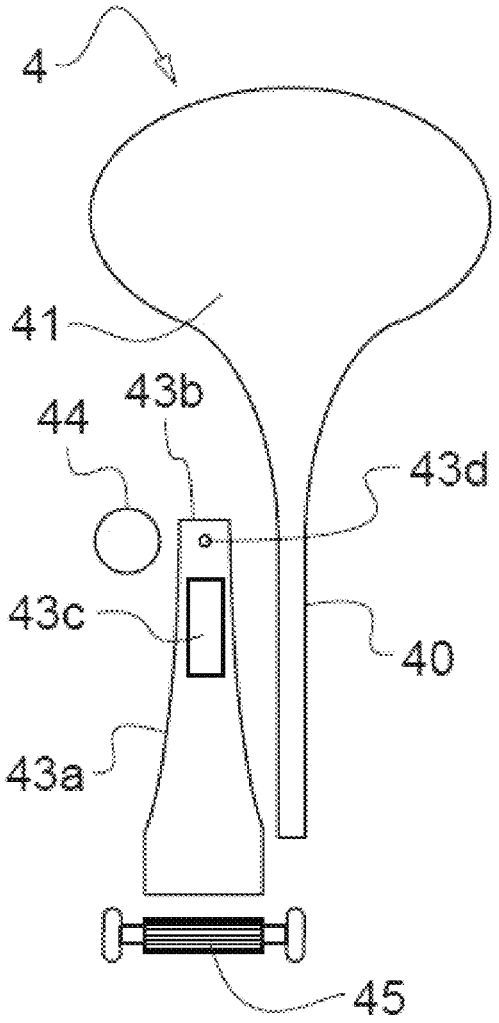
[Fig. 12D]
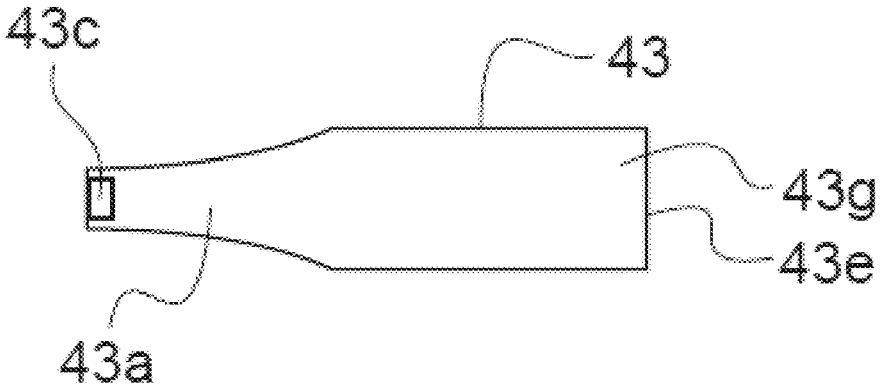

[Fig. 13A]
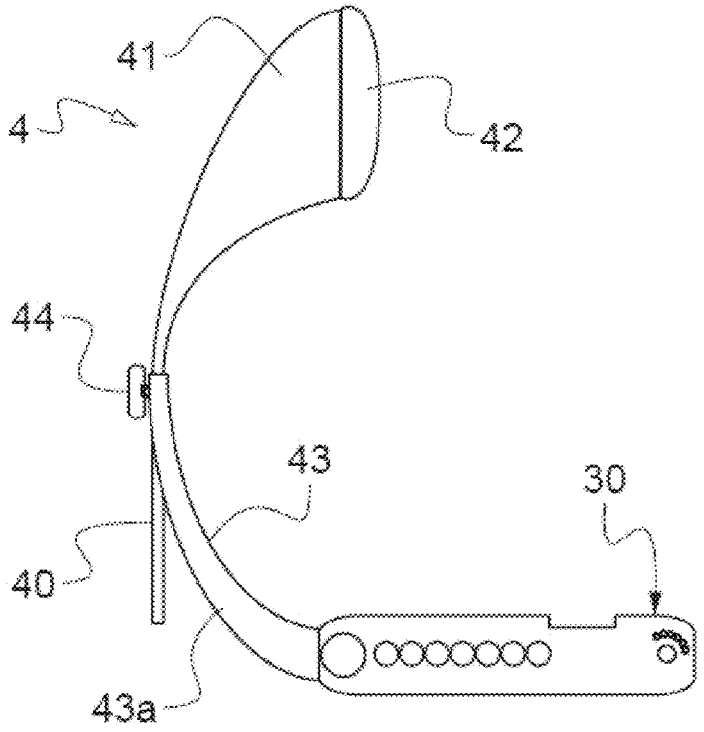
[Fig. 13B]
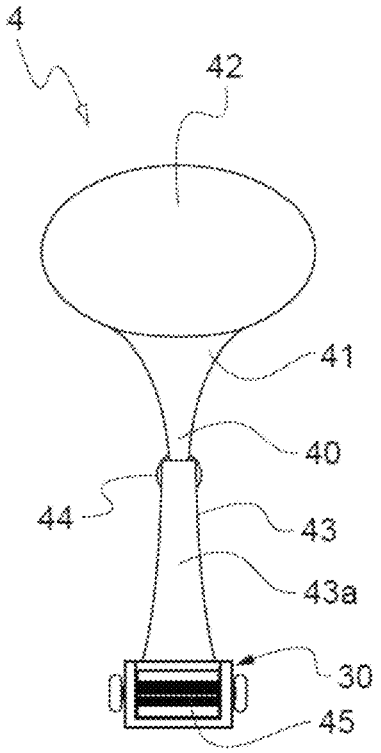

[Fig. 14A]
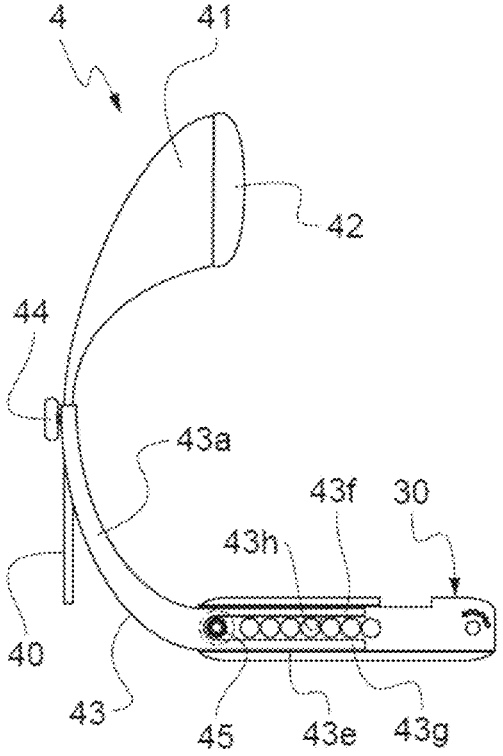
[Fig. 14B]
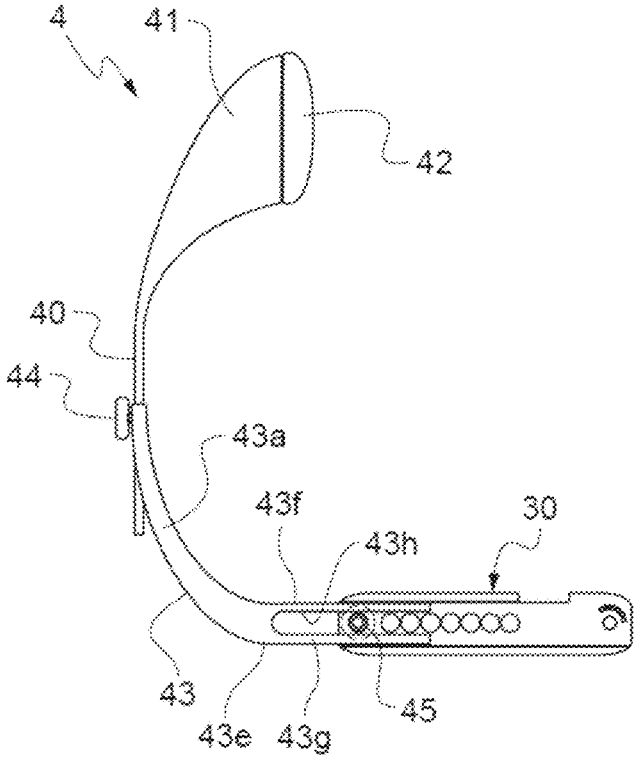

[Fig. 15A]
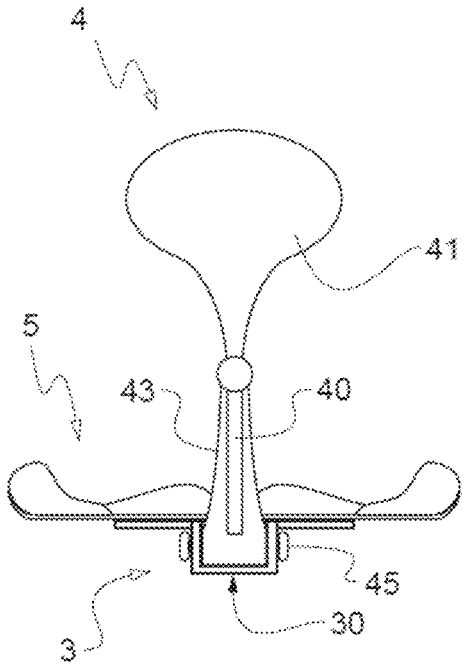
[Fig. 15B]
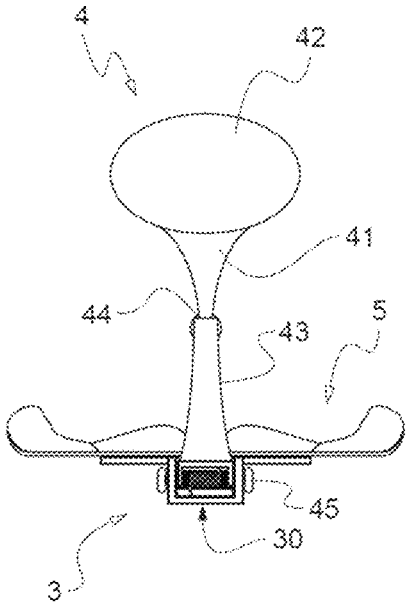

[Fig. 15C]
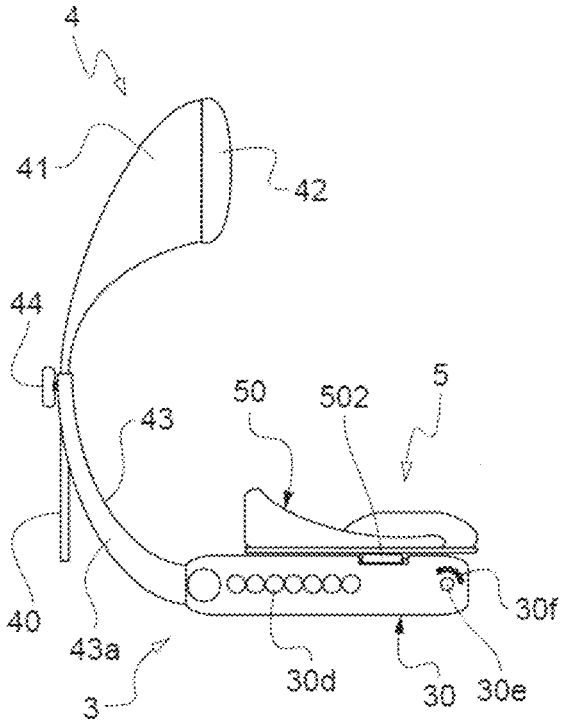
[Fig. 15D]
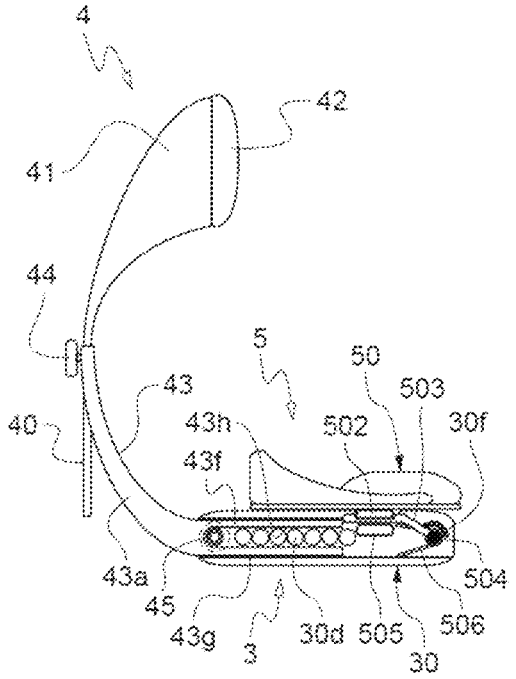

[Fig. 16A]
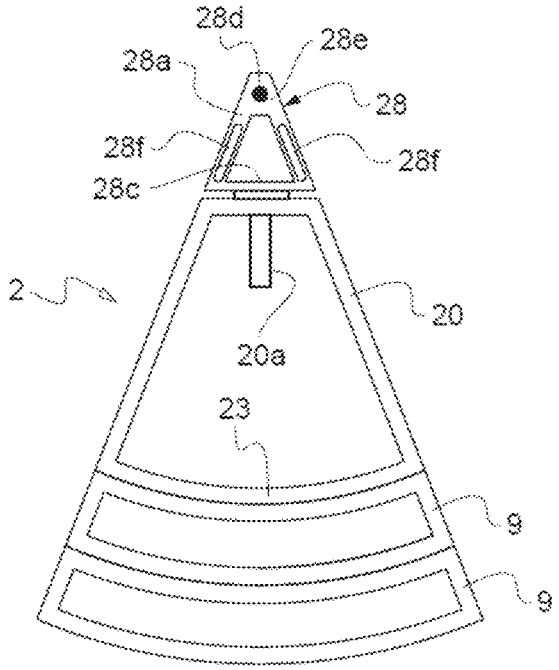
[Fig. 16B]
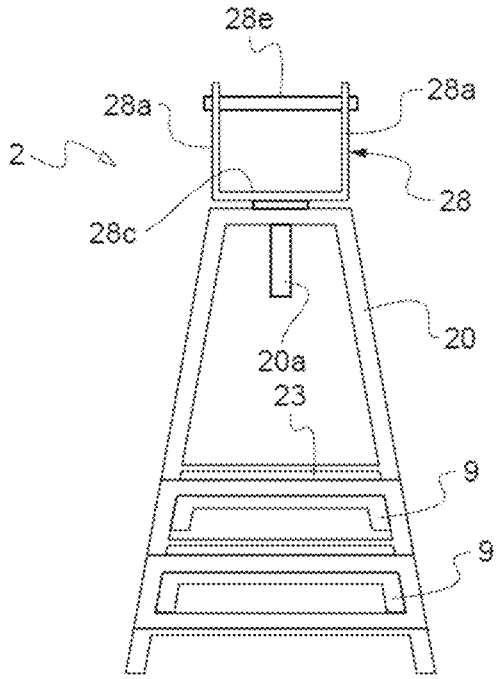

[Fig. 17A]
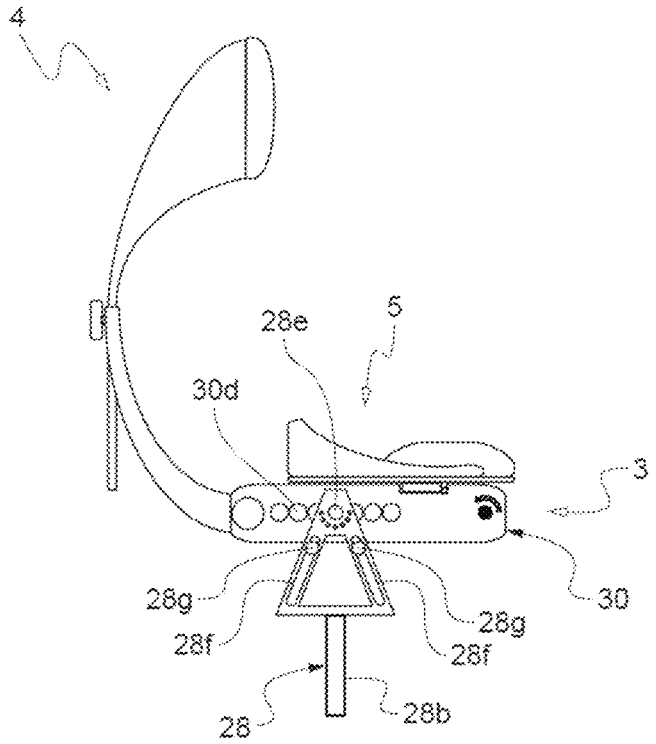
[Fig. 17B]
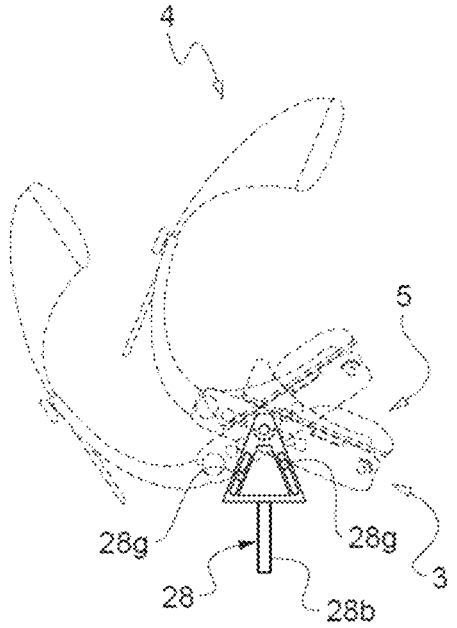

[Fig. 17C]
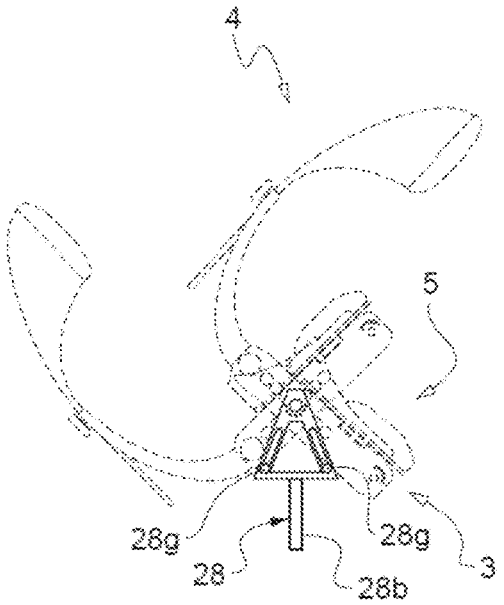
[Fig. 18A]
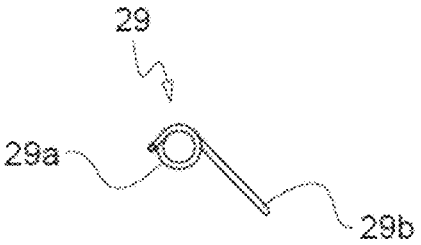
[Fig. 18B]
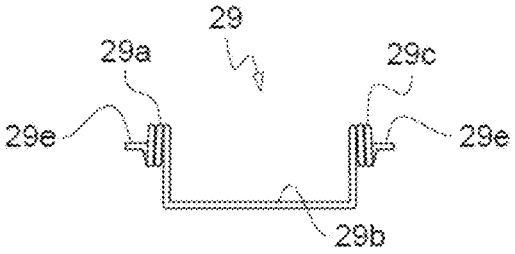

[Fig. 18C]
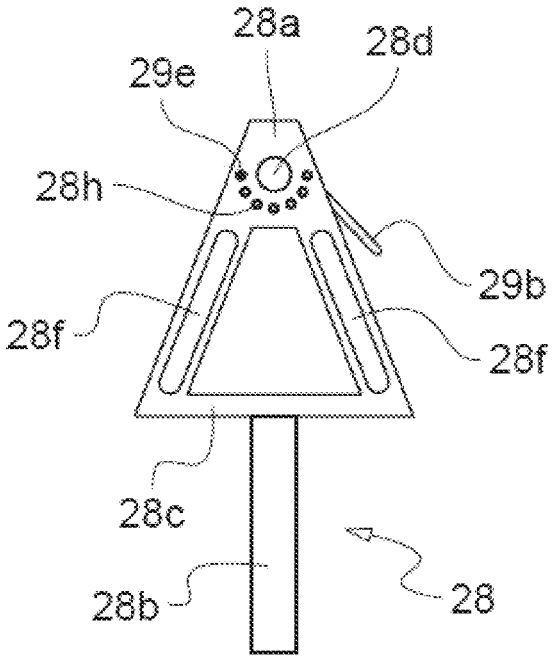
[Fig. 18D]
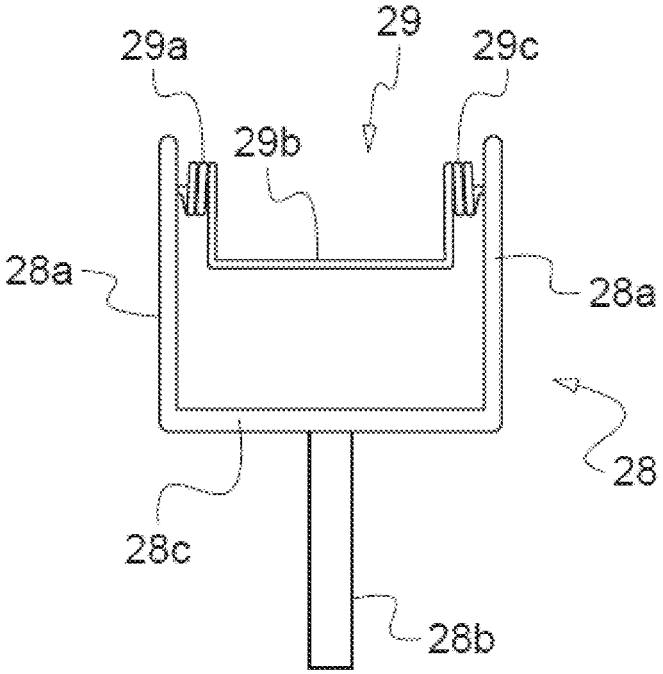

[Fig. 19A]
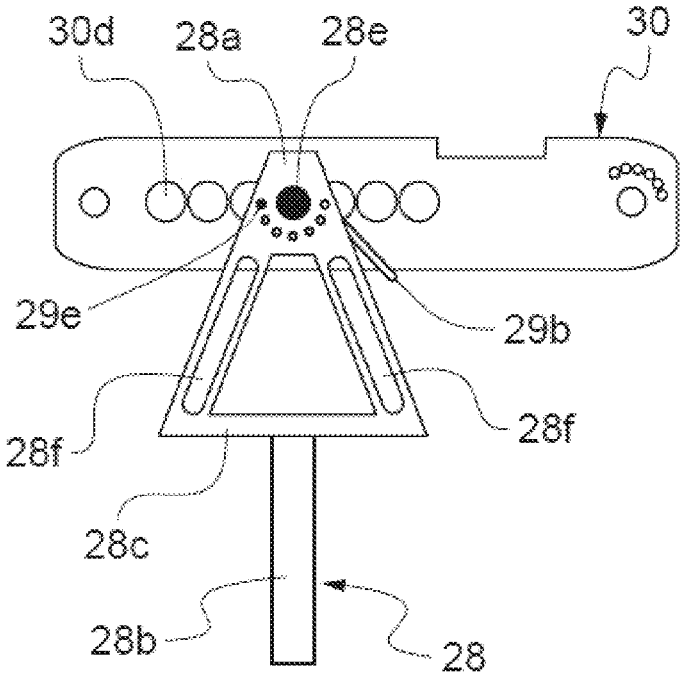
[Fig. 19B]
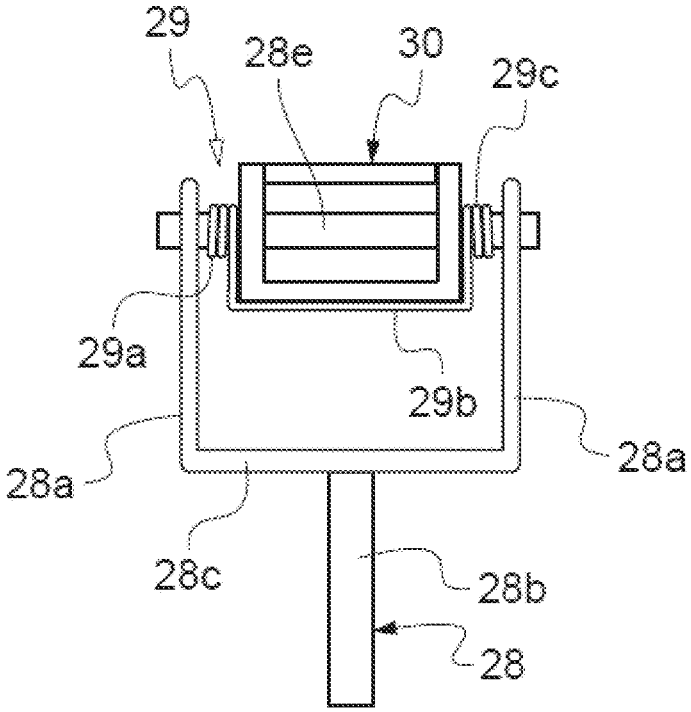

[Fig. 20A]
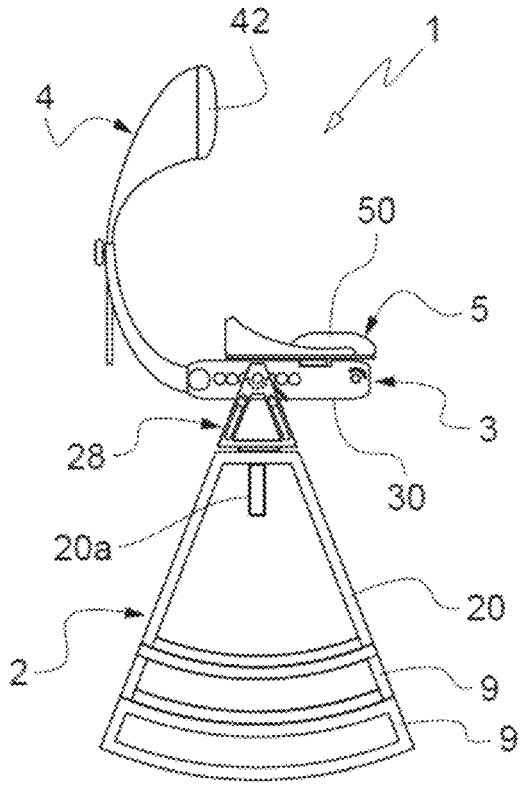
[Fig. 20B]
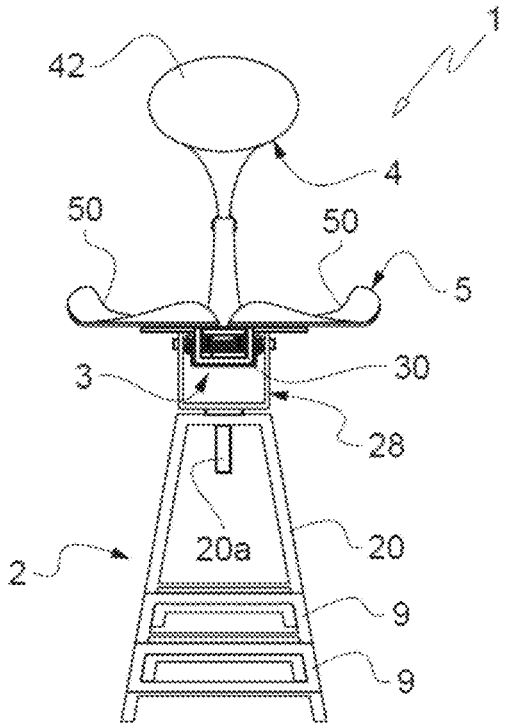

[Fig. 20C]
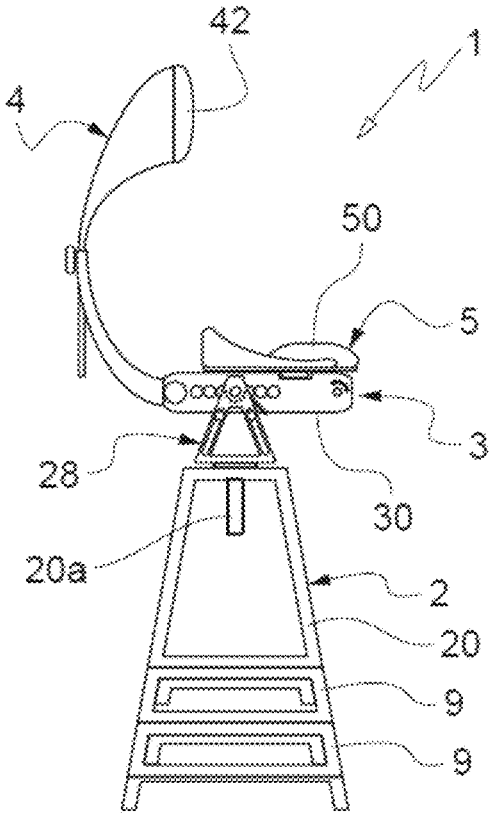
[Fig. 20D]
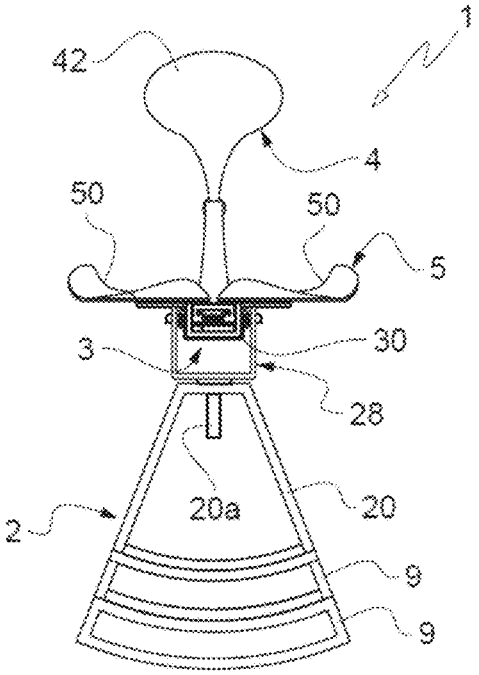

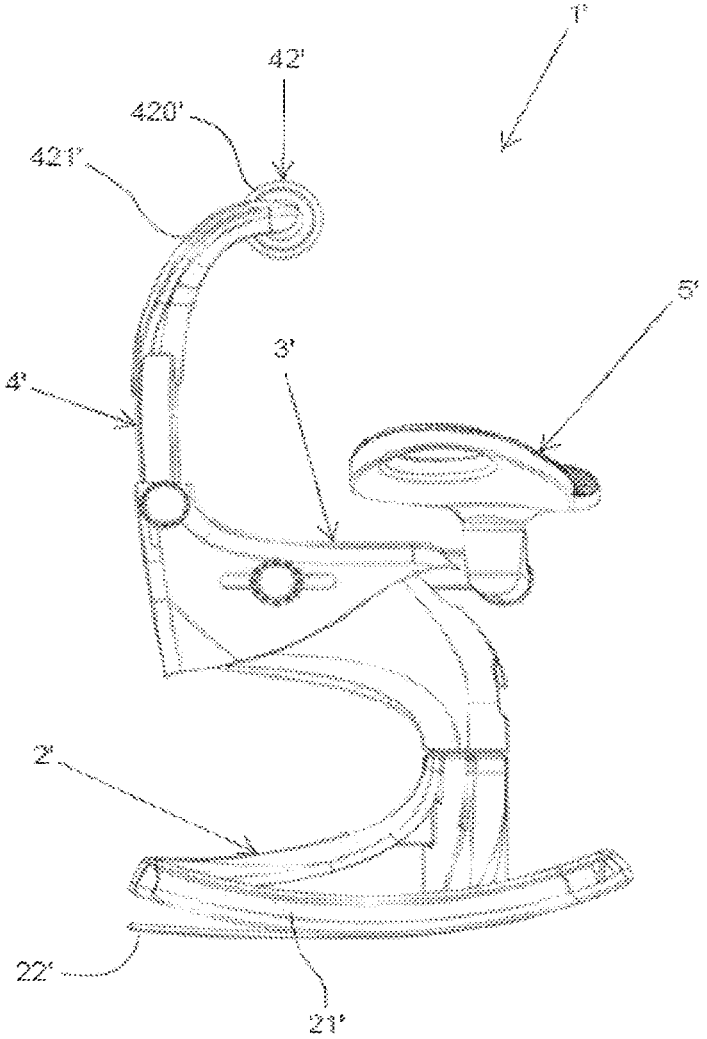
[Fig. 21]

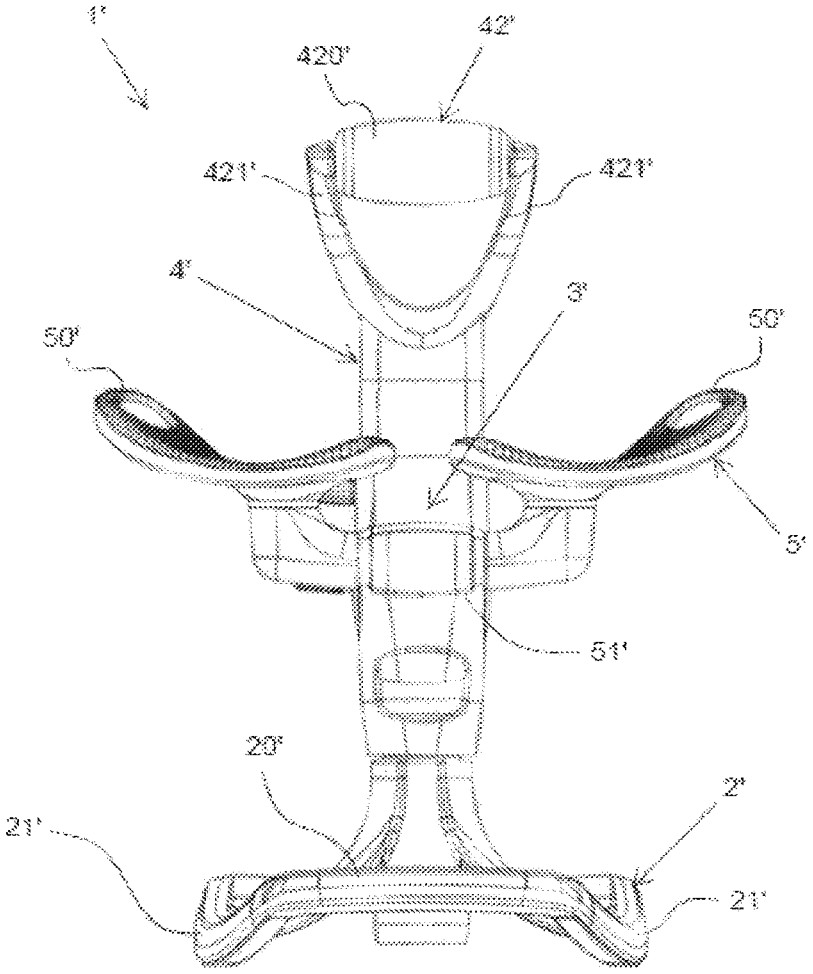
[Fig. 22]

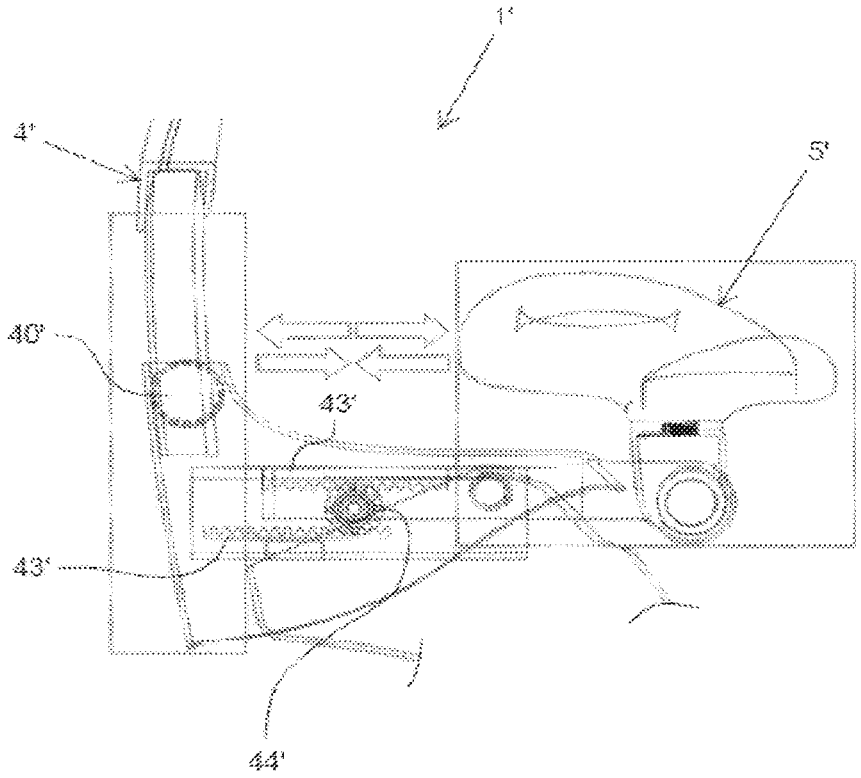
[Fig. 23]

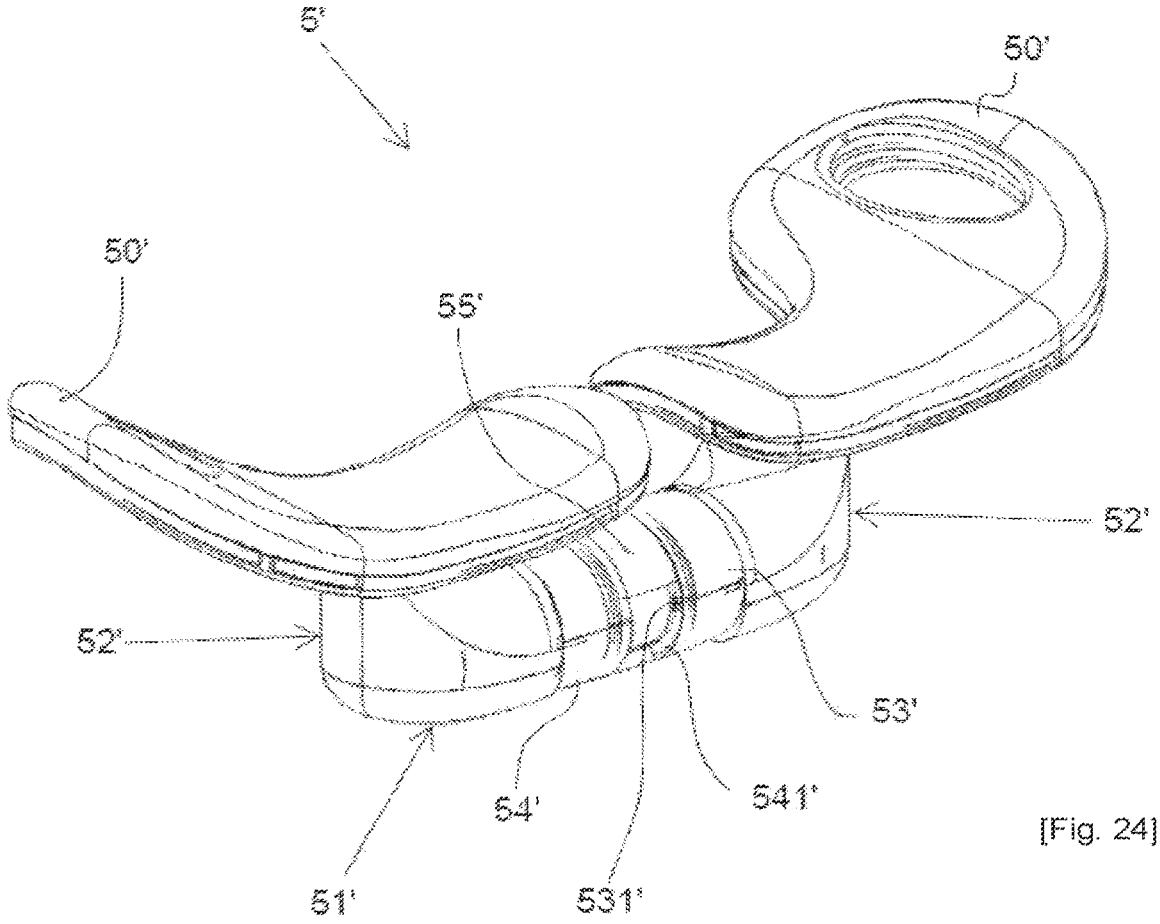
[Fig. 24]
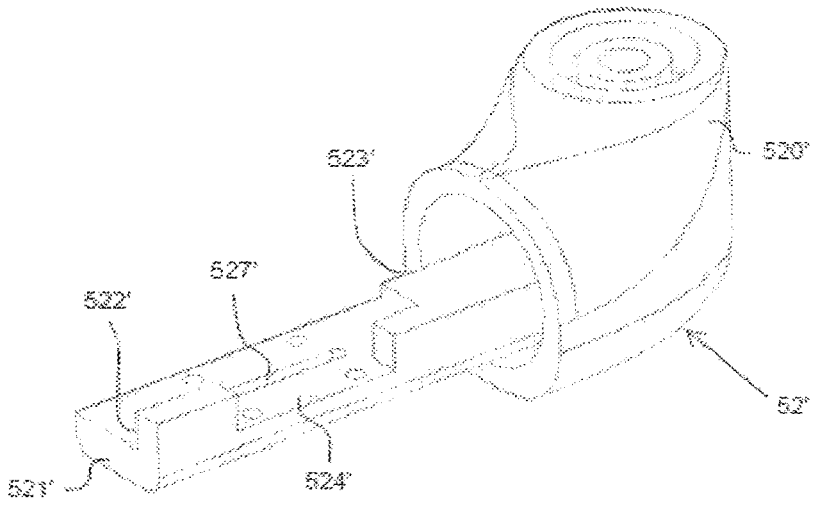
[Fig. 25]

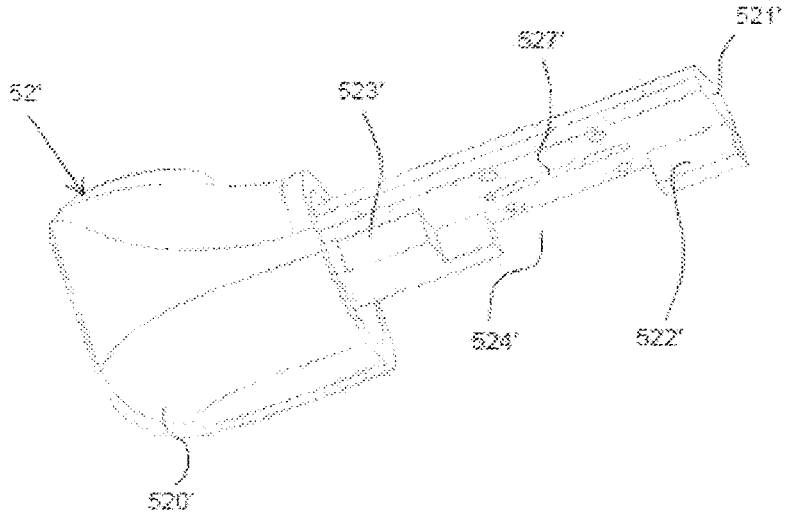
[Fig. 26]
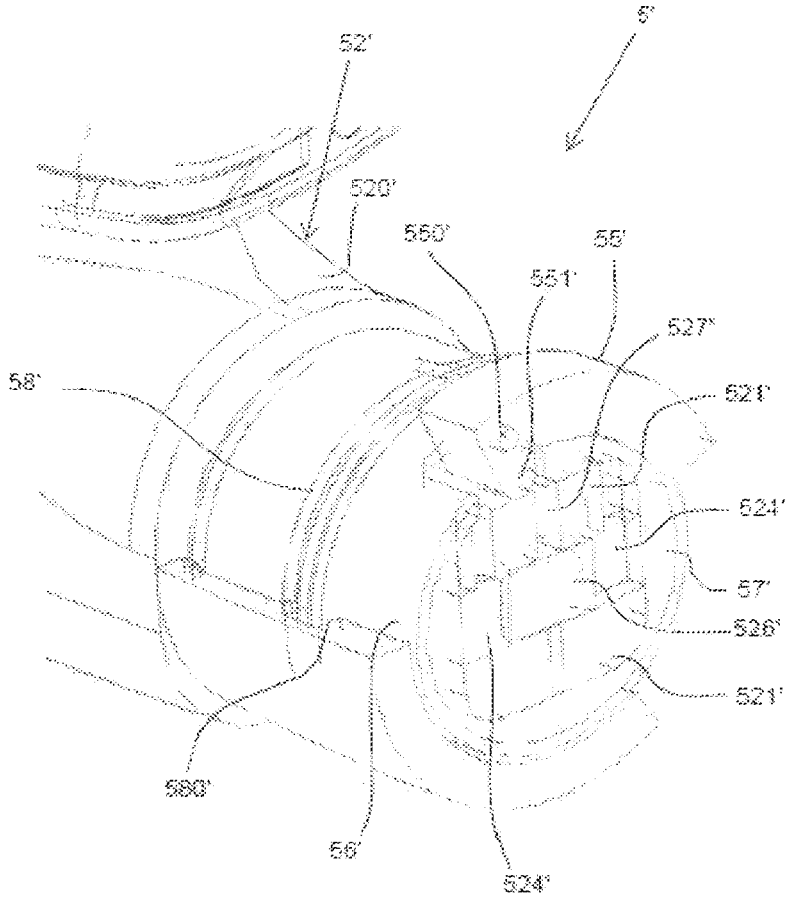
[Fig. 27]

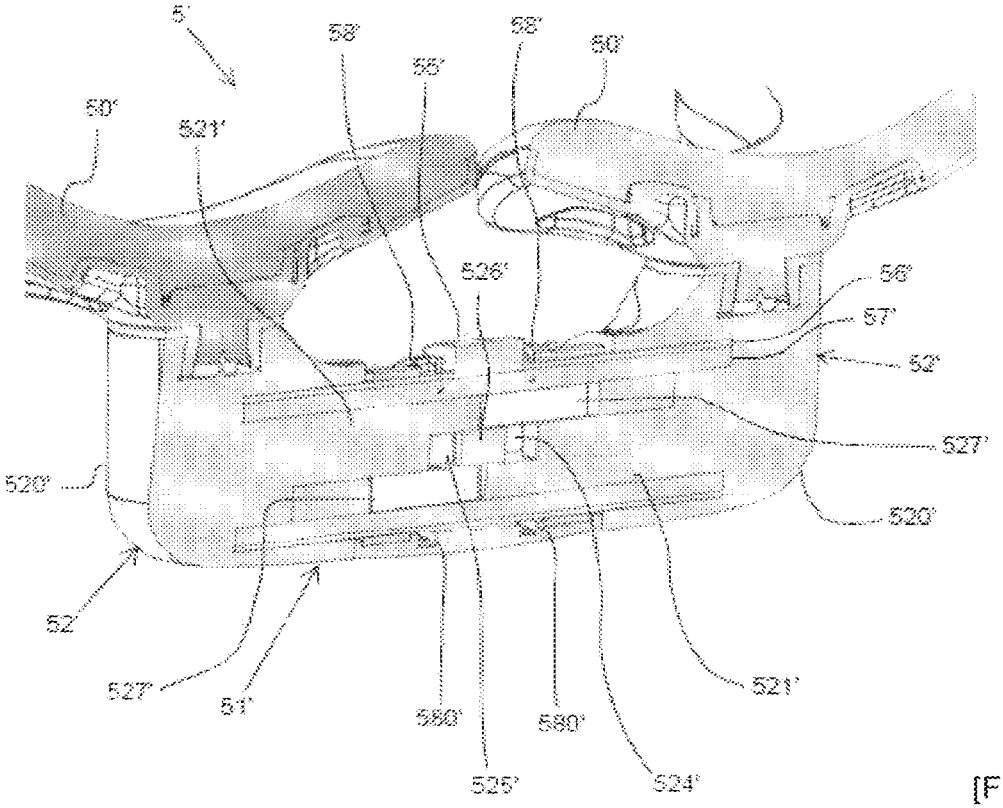
[Fig. 28]
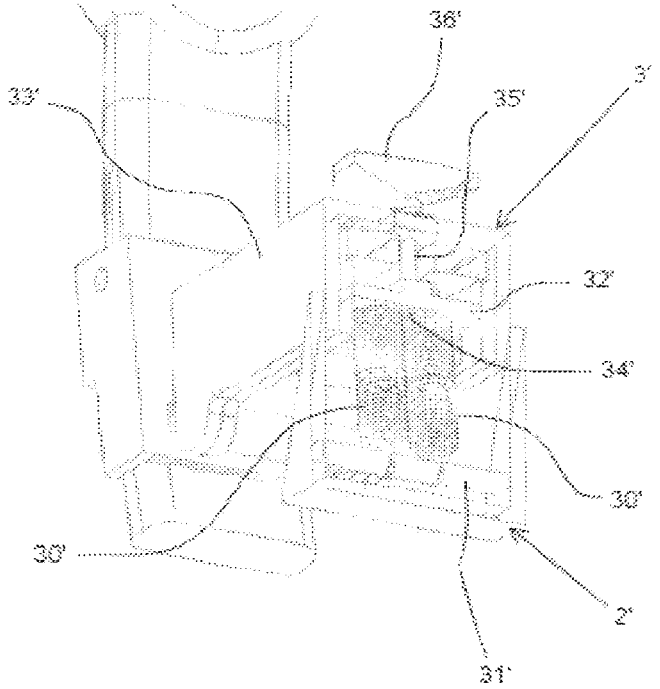
[Fig. 29]

[Fig. 30]
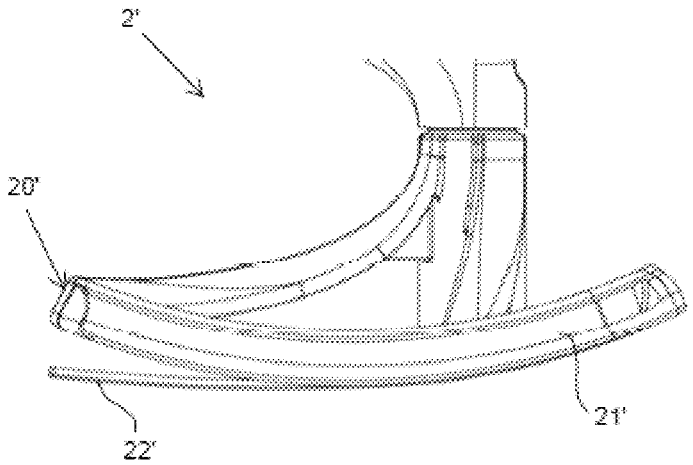
[Fig. 31]
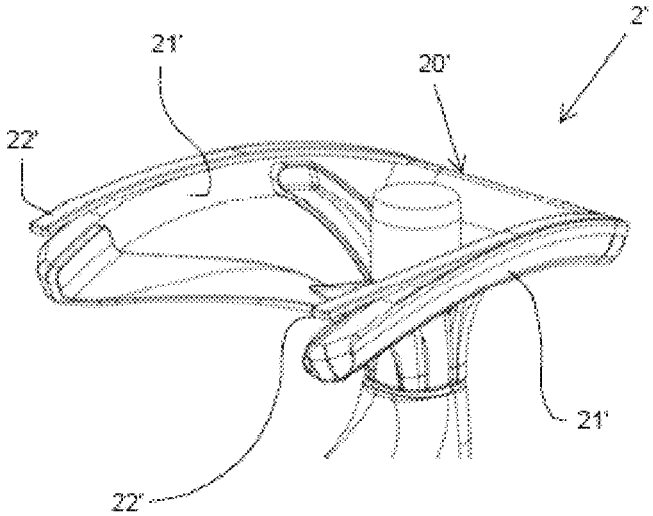

PHYSIOLOGICAL SEAT DEVICE

The present invention relates to the field of preventing morphological and functional problems of the body caused by the current sitting position. It more particularly relates to a physiological seat device enabling such prevention.

The original human had two major dominant functional modes:

- the vertical physiological mode associated with movement, action and the vertical position, in which the respiratory mechanism is ensured by the tonic-phasic activity of the diaphragm and abdominal belt; and
- the horizontal physiological mode associated with immobility, relaxation, rest and the horizontal posture, in which the respiratory mechanism is ensured by the isolated tonic-phasic activity of the diaphragm while the abdominal belt is passive.

Nowadays, with sedentariness and the sitting position, a third dysfunctional mode is dominant which is associated with the vertical posture and the respiratory mechanism of relaxation. This is the mode of postural-respiratory degeneration.

It has morphological consequences with the progressive increase of:

- the relaxation and distention of the abdominal wall;
- the compression and compaction of the vertebral column;
- the stretching and elongation of the pharynx; and
- the collapse of the oral cavity floor, the rib cage and the diaphragm.

It has functional consequences:

- the ventilatory efficiency of the respiratory muscles decreases with the collapse of the diaphragm;
- the stiffness of the rib cage increases through insufficient mobilization and through "locking" with the accentuation of the thoracic kyphosis;
- the average respiratory power increases with the ventilation/minute to compensate for the drop in the current volume and the increase in the dead space;
- the compliance of the pharyngeal walls increases with the elongation of the pharynx;
- obstructive ventilatory sleep disorders (OVSD) increase with the respiratory power and the compliance of the pharyngeal walls;
- the quality of sleep decreases with OVSDs;
- metabolic and cognitive performance decreases with the deterioration of sleep and respiration;
- the individual productivity relative to potential decreases with physical and mental performance;
- the quality of life diminishes;
- chronic infections increase; and
- the social cost of the individual increases.

For this reason, the present inventor has proposed a belt to prevent postural-respiratory degeneration and for postural-respiratory rehabilitation, which was the subject-matter of French patent FR2985902 and which comprises a belt portion with a ventral part able to be applied and maintained on the lower abdomen of the wearer in a zone comprised between the pubis and the umbilicus, and tightening means allowing the ventral part to ensure compression of the lower abdomen of the wearer so as to supplement the stretching and counter-thrust function on the diaphragm when the abdominal belt is inactive in a vertical situation, and thus to promote:

- the ventilatory efficiency of the respiratory muscles;
- the flexibility, mobility and capacity of the rib cage;
- the decrease in the average respiratory power and the inspiratory transparietal pressures; and
- the decrease in the mechanical stresses experienced by the axial skeleton, etc.

However, this belt shows its limitations in the sitting position when the pelvis is poorly positioned. It also does not address the anti-physiological nature of the sitting position. Today, the present inventor proposes an alternative device to the conventional chair. A device that makes it possible to offer physiological conditions for sitting and orientation of the pelvis. A device which, on the contrary, requires, without effort or discomfort, maintaining an organization and a mobility of the vertebral column in line with human physiology in a vertical posture.

The optimal physiological posture is characterized, in the vertical position, by an alignment of the atlanto-occipital and coxofemoral joints on a vertical line, tangent to the anterior edge of the third lumbar vertebra, projected onto the ground in the middle of the feet. This optimal posture is illustrated in FIG. 1A, which shows the vertebral column C and the pelvis B of the person, and reference P1 designates the atlanto-occipital joint, P2 designates that of the coxofemoral joints which appears in FIG. 1A, Lb designates the $3^{rd}$ lumbar vertebra and V designates the vertical.

FIG. 1B illustrates a person with a pelvic retroversion, illustrated by a counterclockwise circle, and thoracic hyperkyphosis, illustrated by a clockwise circle.

It is stressed here that, in the description, the claims and the drawings, the right profile of the user has been used by convention to define the clockwise and counterclockwise directions. Of course, these directions are reversed if the left profile of the user is considered.

As can be seen in FIGS. 2A and 2B, which illustrate two conventional postures of a person in the sitting position on a conventional chair, only the seat and the backrest of which have been shown, the sitting position causes pelvic retroversion and thoracic hyperkyphosis, also illustrated by counterclockwise and clockwise circles, respectively. The sitting position thus favors postural-respiratory degradation and expressions thereof: fatigue, stress, health degradation, etc.

The sitting position is a major public health problem.

The present invention therefore aims to propose a solution making it possible to correct the sitting position of a person so that it is optimal and in accordance with human physiology in the vertical position, while making it possible to avoid pelvic retroversion, lumbar delordosation, thoracic hyperkyphosis, hypotonia of the trunk and the orthopedic, morphological and metabolic consequences thereof.

The solution according to the present invention is a seat device comprising an underframe and a seat comprising a rear region and a front region, characterized in that the seat is connected to the underframe by a link allowing the seat to pivot relative to the underframe about a pivot axis, called seat axis, which is horizontal and orthogonal to the depth direction of the seat, said link being positioned relative to the seat such that the seat pivots toward the front when a user sits on the scat, there being provided means for elastically biasing the seat in rotation toward the rear, and by the fact that the seat device further comprises a lumbar part which is rotationally secured to the seat and positioned so as, during use, to press against the back of the user, at the lumbar vertebrae of the latter, and a saddle for supporting at least a portion of the thighs of the user, the saddle being connected to the front region of the seat.

When the user sits on the seat device according to the present invention, he places his thighs on the saddle and his weight will press on the saddle at the point of intersection between the saddle and the vertical passing through the center of gravity of the user, in other words in front of the seat axis. The weight of the user will therefore exert on the seat, due to the lever arm between the seat axis and said point of intersection, a rotation torque in the clockwise direction, therefore in the direction opposite the biasing exerted on the seat by the respective elastic biasing means, the latter also being configured so that the biasing that they exert is less than the stress exerted by the user. This rotation torque in the clockwise direction causes the seat to pivot integrally with the lumbar part in the clockwise direction until the lumbar part bears against the back of the user, at the lumbar vertebrae, in order to orient the vertebral column and the pelvis correctly. It is stressed here that the saddle contributes to the freedom of correctly orienting the pelvis in the sitting position.

Thus, the seat device according to the present invention allows the simultaneous correction of the orientation of the pelvis and of the organization of the vertebral column, without the user having to take any action other than simply sitting on the seat device.

Preferably, the saddle is connected to the front region of the seat by a link allowing the pivoting of the saddle relative to the seat about a pivot axis, called saddle axis, which is parallel to the seat axis and in front of the seat axis in the depth direction of the seat, means being provided for elastically biasing the saddle toward the front.

Thus, when the user places his thighs on the saddle, his weight will, in addition to the seat, cause the saddle to pivot in the counterclockwise direction, against the biasing exerted on the saddle by the respective elastic biasing means, the latter being configured so that the biasing which they exert is less than the stress exerted by the user. However, the stress exerted by the saddle on the user further improves the prevention of pelvic retroversion due to the position of the saddle on the user's €highs, and therefore due to the absence of bearing on the pelvis or the sacrum.

Preferably, the seat device comprises stops positioned in order to limit the pivoting travel of the seat and/or, if applicable, of the saddle, in both directions of rotation.

Preferably, the link between the seat and the underframe is a first pivot link and, if applicable, the link between the saddle and the seat is a second pivot link, the first and second pivot links each comprising a pivot making up the seat axis and the saddle axis, respectively.

Preferably, the means for elastically biasing the seat and/or, if applicable, the saddle are springs, in particular torsion springs, preferably with adjustable tension.

Preferably, the seat is mounted with adjustable position, in the depth direction of the seat, relative to the underframe, so as to allow the adjustment of the distance between the seat axis and the saddle axis, in the depth direction of the seat.

The lumbar part can be fixed to or formed by a portion of the backrest, preferably a portion of the backrest, in particular the free end region of the backrest, that is returning toward the front region of the seat.

Preferably, the lumbar part is position-adjustable, relative to the seat axis, in the vertical direction and in the depth direction of the seat, so as to allow the position of the lumbar part to be adjusted as a function of the build of the user.

Preferably, the saddle is formed by two portions which are symmetrical relative to a vertical plane to which the depth direction of the seat belongs, each portion of the saddle being intended to bear the thigh of the user, the separation between the two portions of the saddle preferably being adjustable.

Preferably, the saddle comprises a front region, which is intended to support the thighs of the user, directly above the axes of the coxofemoral joints of the user, and a rear region which is hollowed out in a medial zone where the ischiums of the user will be located and which rises up in its two lateral zones, so as to slightly surround the inferolateral portions of the buttock.

Preferably, the underframe is of the tilting type at least in the sagittal plane, optionally also in the transverse plane.

Such an underframe of the tilting type makes the seat device unstable to a certain extent. This instability of the underframe makes it possible to stress the muscle chains of the trunk of the user when he is seated on the seat device, similarly to how they are stressed when the user is standing and the pelvis is unstable and oscillates on the pivots of the lower limbs. The seat device then makes it possible to prevent hypotonia of the trunk.

The underframe can have a rounded base optionally having means for nesting height adjusting wedge, following the same curve as the base.

The seat device can further comprise means for defining the maximum tilting amplitude of the underframe, preferably comprising feet mounted in translation relative to the underframe so as to be movable between a position in which they protrude relative to the underframe so as to be able to come into contact with the floor to oppose the tilting of the underframe, and a position in which they do not protrude relative to the underframe.

It is possible to provide elastic biasing means, for example springs, to bias the feet toward the position in which they protrude relative to the underframe.

To better illustrate the subject matter of the present invention, one particular embodiment will be described hereinafter, for information and non-limitingly, with reference to the appended drawings.

In these drawings:

FIG. 1A is a schematic side view of a person in the optimal posture.

FIG. 1B is a schematic side view of a person in a posture with pelvic retroversion and thoracic kyphosis.

FIG. 2A is a schematic side view of a person seated on a conventional chair, in a first posture.

FIG. 2B is a schematic side view of a person seated on a conventional chair, in a posture different from that of FIG. 2A.

FIG. 3 is a schematic side view of a seat device according to a particular embodiment of the present invention.

FIG. 4A is a schematic side view of the seat device of FIG. 3, at a first instant when a person sits on the seat device.

FIG. 4B is a schematic side view of the seat device of FIG. 3, at a second instant when a person sits on the seat device.

FIG. 4C is a schematic side view of the seat device of FIG. 3, at a third instant when a person sits on the seat device.

FIG. 4D is a schematic side view of the seat device of FIG. 3, at a fourth instant when a person sits on the seat device.

FIG. 5A is a schematic side view of the seat device of FIG. 3, a person being seated on the seat device in the vertical position.

FIG. 5B is a schematic side view of the seat device of FIG. 3, when a person is seated and moves forward.

FIG. 5C is a schematic side view of the seat device of FIG. 3, when a person is seated and moves back.

FIG. 5D is a schematic side view of the seat device of FIG. 3, when a person is seated and leans back.

FIG. 5E is a schematic side view of the seat device of FIG. 3, when a person is seated and leans forward.

FIG. 6 is a schematic side view of the underframe of the seat device.

FIG. 7A is a side view of a saddle made of two portions and the means thereof for adjusting their separation and their orientation.

FIG. 7B is a front view of the saddle of FIG. 7A.

FIG. 7C is an exploded side view of the saddle of FIG. 7A.

FIG. 7D is an exploded front view of the saddle of FIG. 7A.

FIG. 7E is a bottom view of the saddle of FIG. 7A.

FIG. 8A is a bottom view of the semi-saddles, in exploded view.

FIG. 8B is a bottom view of the semi-saddles, in a maximally close/non-oriented position.

FIG. 8C is a bottom view of the semi-saddles, in an intermediate separation/non-oriented position.

FIG. 8D is a bottom view of the semi-saddles, in a maximally close/center-oriented position.

FIG. 8E is a bottom view of the semi-saddles, in a maximally close/outwardly-oriented position.

FIG. 9A is a side view of a seat body.

FIG. 9B is a side view of the seat body of FIG. 9A, with side wall omitted.

FIG. 9C is a back view of the seat body of FIG. 9A.

FIG. 9D is a front view of the seat body of FIG. 9A.

FIG. 9E is a top view of the seat body of FIG. 9A.

FIG. 9F is a bottom view of the seat body of FIG. 9A.

FIG. 10A is a side view showing the saddle and the seat body.

FIG. 10B is a view similar to FIG. 10A, with maximal pivoting travel of the saddle.

FIG. 10C is a view similar to FIG. 10A, with intermediate travel and minimal travel.

FIG. 10D is a front view corresponding to FIG. 10C.

FIG. 11A is a view similar to FIG. 10A, a side wall of the seat body having been omitted.

FIG. 11B is a view similar to FIG. 10B, a side wall of the seat body having been omitted.

FIG. 11C is a view similar to FIG. 10C, a side wall of the seat body having been omitted.

FIG. 11D is a view similar to FIG. 10D, a side wall of the seat body having been omitted.

FIG. 12A is a view showing the backrest and the part for linking to the seat body, in exploded side view.

FIG. 12B is a front view of the backrest and the part for linking to the seat body.

FIG. 12C is a back view of the backrest and the part for linking to the seat body.

FIG. 12D is a bottom view of the linking part.

FIG. 13A is a side view of the backrest connected to the seat body by the linking part.

FIG. 13B is a front view of the backrest connected to the seat body by the linking part.

FIG. 14A is a side view of the backrest connected to the seat body, a side wall of the seat body having been omitted, at the minimum depth and height of the backrest.

FIG. 14B is a view similar to FIG. 14A, with intermediate depth and height of the backrest.

FIG. 15A is a back view of the saddle, backrest and seat assembly.

FIG. 15B is a front view of the saddle, backrest and seat assembly.

FIG. 15C is a side view of the saddle, backrest and seat assembly.

FIG. 15D is a side view of the saddle, backrest and seat assembly, with a side wall of the seat body omitted.

FIG. 16A is a side view of the underframe.

FIG. 16B is a front view of the underframe.

FIG. 17A is a side view showing the link to the underframe of the seat body, with an adjustment preventing any pivoting of the seat body.

FIG. 17B is a side view similar to FIG. 17A, showing a first adjustment of the stops for pivoting toward the front and toward the rear.

FIG. 17C is a side view similar to FIG. 17A, showing a second adjustment of the stops for pivoting toward the front and toward the rear.

FIG. 18A is a side view of a spring part.

FIG. 18B is a front view of the spring part.

FIG. 18C is a side view showing the spring part mounted on the support of the underframe.

FIG. 18D is a front view showing the spring part mounted on the support of the underframe.

FIG. 19A is a side view showing the seat body mounted on the support, which in turn is provided with the spring part.

FIG. 19B is a front view of FIG. 19A.

FIG. 20A is a side view of a seat device according to FIGS. 7A to 19B, the underframe being in a tilting configuration in the sagittal plane.

FIG. 20B is a front view of the seat device of FIG. 20A.

FIG. 20C is a side view of a seat device according to FIGS. 7A to 19B, the underframe being in a tilting configuration in the transverse plane.

FIG. 20D is a front view of the seat device of FIG. 20C.

FIG. 21 is a side view of a variant embodiment of the seat device of FIG. 20A.

FIG. 22 is a front view of the seat device of FIG. 21.

FIG. 23 is a side view schematically showing the means for adjusting the distance between the lumbar part and the saddle.

FIG. 24 is a perspective view of the saddle alone.

FIG. 25 is a perspective view of one saddle portion support.

FIG. 26 is a perspective view of the other saddle portion support.

FIG. 27 is a cross-sectional view of the saddle, the upper cover not having been shown.

FIG. 28 is a longitudinal sectional view of the saddle, the upper cover not having been shown.

FIG. 29 is a cross-sectional view of the seat, showing the means for adjusting the magnitude of the elastic biasing exerted by the means for elastically biasing the seat toward the rear.

FIG. 30 is a front view showing, in detail, the underframe of the seat device of FIG. 21.

FIG. 31 is a perspective view showing the underframe of FIG. 30, in a position turned upward.

FIG. 3 schematically shows a seat device 1 according to one embodiment of the present invention. The seat device 1 comprises an underframe 2, a seat 3, a backrest 4 and a saddle 5.

The underframe 2 is defined so as to rest, by its lower part, on the floor and to support, by its upper portion, the seat 3, the backrest 4 and the saddle 5.

As emerges from the following description, the underframe 2 according to the present invention is remarkable by the arrangement of its lower portion, or base, and of its upper portion. Thus, in the Figures, the underframe 2 has been shown schematically by a circular sector delimited by two straight lines 21 coming together in an apex embodying the upper portion 22 of the underframe 2 and by an are of circle connecting the ends of the lines 21 and embodying the lower portion 23 of the underframe 2.

The present invention is not limited to any one structure of the underframe 2 between the upper portion 22 and the lower portion 23, and it would be possible to use, for the upper 22 and lower 23 portions, structures which are already used in conventional chairs, for example metal rods.

In this embodiment, the underframe 2 is of the tilting type, which means that its lower portion 23 effectively has at least one contact surface with the floor that follows an arc of circle whose center, according to the present invention, belongs to the horizontal line passing through the upper portion 22 of the underframe 2. Such a contact surface will be able to be implemented according to any appropriate form, also well known in itself, for example through the use of two curved parts, in particular made from wood, connecting four feet of the underframe. It would also be possible, for example, to provide a single contact surface defined by a plate which follows an arc of cylinder whose axis is horizontal and passes through the upper portion 22 of the underframe 2.

Such an underframe 2 of the tilting type offers the user a functional and dynamic posture by allowing him to tilt forward and backward in the sagittal plane, as will emerge from FIGS. 5A to 5E.

Furthermore, the underframe 2 is not stable, and the muscle chains of the trunk of the user will therefore be stressed when the user naturally seeks equilibrium. Hypotonia of the trunk is thus prevented.

It is stressed here that it would also be possible to provide that the lower portion 23 allows tilting of the seat device 1 to the left and to the right, in other words transversely to the sagittal plane, so as to further amplify the functional and dynamic nature of the seat device 1. It would thus be possible to provide that the lower portion 23 is formed by a plate which follows a spherical cap of a sphere whose center is located on the horizontal line passing through the upper portion 22 of the underframe 2.

The upper portion 22 of the underframe 2 is connected to the seat 3 by a pivot link 6, shown by a circle in FIG. 3, allowing relative pivoting between the underframe 2 and the seat 3 about a pivot axis, called seat axis, designated by reference A1 and shown by a smaller circle in FIG. 3. Here, the seat axis A1 is located globally in the median portion of the seat 3, when considered in the depth direction of the seat 3.

According to the present invention, the seat device 1 also comprises means for elastically biasing the seat 3 in rotation in the counterclockwise direction, as illustrated by a circle bearing arrow F1 in FIG. 3. Here again, these elastic biasing means may be implemented in any appropriate form without departing from the scope of the present invention.

Adjustable stops for stopping the pivoting of the seat 3 (not shown in FIG. 3) can be carried or formed by the underframe 2 in order to define the ends of travel of the seat 3 in the counterclockwise direction and in the clockwise direction.

In the embodiment shown schematically in the Figures, the seat 3 and the backrest 4 are integral with each other, as a single part whereof a first region, extending globally horizontally, forms the seat 3 and whereof a second region, extending globally vertically, forms the backrest 4. Here, this part has been given a shell shape, for a pleasing and modern esthetic appearance. It is therefore easy to understand that the backrest 4 will pivot together with the seat 3 about the axis A1.

The backrest 4 extends from a rear region 31 of the seat 3 and has a free end region 41, namely the region of the upper horizontal edge of the backrest 4, which returns horizontally at least slightly toward the front region 32 of the seat 3. A buffer 42, forming the lumbar part according to the present invention, here is fastened to the free end region 41, so as to form the portion of the backrest 4 which will come into contact with the back of the user. The lumbar part 42 may be made from foam and fabric, rubber, etc. Of course, the lumbar part 42 could be formed directly by the free end region 41 of the backrest 4, and not by a part attached thereon.

As will be described hereinafter, the backrest 4 is sized so that the lumbar part 42 is located at the height of the lumbar vertebrae of the user seated on the seat device 1. Advantageously, the lumbar part 42 offers a convex surface, to prevent the contact of the lumbar part 42 against the back of the user from leading to pain or bother in the user.

The saddle 5 is configured to support the thighs of the seated user, directly above the axis of the coxofemoral joints. The saddle 5 is connected to the seat 3, at the front region 32 of the latter, by a pivot link 7, shown by a dot in FIG. 3, allowing a relative pivoting between the seat 3 and the saddle 5 about a pivot axis, called saddle axis, designated by reference A2 and shown by the same point in FIG. 3. The saddle axis A2 is therefore located in front of the seat axis A1, in the depth direction of the seat 3.

According to the present invention, the seat device 1 also comprises means for elastically biasing the saddle 5 in rotation in the clockwise direction, as illustrated by a circle bearing arrow F2 in FIG. 3. Here again, these elastic biasing means may be implemented in any appropriate form without departing from the scope of the present invention.

Stops for stopping the pivoting of the saddle 5 (not shown in FIG. 3) are carried or formed by the seat 3 in order to define the ends of travel of the saddle 5 in the counterclockwise direction and in the clockwise direction.

For example, the various stops may be positioned such that when there is no person seated on the seat device 1, the seat 3, the backrest 4 and the saddle 5 are in the configuration illustrated in FIG. 3: the seat 3 and the backrest 4 are at least slightly inclined toward the rear and the saddle 5 is at least slightly inclined toward the front. This particular configuration allows the user to sit naturally on the seat device 1, as can be seen in FIGS. 4A to 4D.

In FIG. 4A, the user is standing up, in the optimal position, in front of the seat device 1, like for a conventional chair.

In FIG. 4B, the user has lowered himself by bending his knees until his thighs is in contact with the saddle 5. One can see that the vertical V1 passing through the atlanto-occipital joint P1 no longer coincides with the vertical V2 passing through the coxofemoral joint P2. The sacrum S is inclined toward the rear by the pelvic retroversion, and the column C is curved toward the rear (thoracic kyphosis).

In FIG. 4C, the user has continued to lower himself, first by pivoting the saddle 5 about the saddle axis A2 in the counterclockwise direction until it comes into contact with the corresponding stop, then secondly by pivoting the seat 3/backrest 4/saddle 5 assembly about the seat axis A1 in the clockwise direction, causing the lumbar part 42 to bear against the back of the user, at the lumbar vertebrae. It may also be noted that the natural movement of the user has also led to a slight pivoting of the entire seat device 1, since the underframe 2 here is of the tilting type.

The user then finds himself already in the optimal posture, in which the atlanto-occipital P1 and coxofemoral P2 joints are aligned on a vertical line V which is tangent to the anterior edge of the third lumbar vertebra Lb, and retains this posture when the seat device 1 returns to the vertical position as shown in FIG. 4D.

This optimal posture is obtained owing to the combined action of the lumbar part 42, which bears against the back of the user at the lumbar vertebrae, and of the saddle 5, which supports the thighs and allows the correct orientation of the pelvis of the user.

The user will retain this optimal posture as long as he remains seated, even if he leans forward or backward, as can be seen in FIGS. 5A to 5E.

In FIG. 5A, the underframe 2 is vertical.

In FIG. 5B, the user has sought to move forward slightly, which has led to the forward tilting of the underframe 2 while the seat 3/backrest 4/saddle 5 assembly remains in the same position as in FIG. 5A, by relative rotation about the seat axis A1, such that the user stays in the optimal posture, in particular with his back vertical.

Likewise, if the user seeks to move back slightly, the underframe 2 will tilt toward the rear while the seat 3/backrest 4/saddle 5 assembly still stays in the same position as in FIG. 5, by relative rotation about the seat axis A1, as shown in FIG. 5C.

If the user leans toward the rear, he will, by his back, pivot the backrest 4 toward the rear, and therefore also the seat 3 and the saddle 5, about the seat axis A1, until the seat 3 comes into contact with the corresponding stop, from which contact the incline of the user toward the rear will be transmitted to the underframe 2 and will tilt the entire seat device 1 toward the rear, as shown in FIG. 5D.

Similarly, if the user leans toward the front, he will pivot the seat 3/backrest 4/saddle 5 assembly toward the front about the seat axis A1 until contact occurs with the corresponding stop, from which contact the incline of the user toward the front will be transmitted to the underframe 2 and will tilt the entire seat device toward the front, as shown in FIG. 5E.

In this movement toward the rear or toward the front, the relative positions of the seat 3, the lumbar part 42 and the saddle 5 remain unchanged, such that the back of the user is kept in the same position as before, with the difference that the atlanto-occipital and coxofemoral joints are aligned on a line L1 which is inclined toward the rear or on a line L2 which is inclined toward the front, and no longer on a vertical line.

As a result, the seat device 1 indeed makes it possible to correct the sitting posture of the user so that it is optimal, so as to prevent pelvic retroversion, lumbar delordosation, thoracic kyphosis and hypotonia of the trunk, while offering the user a freedom of movement in order to give him a functional and dynamic seat.

FIG. 6 shows a schematic view of the underframe 2 provided with an example of end of travel means 24 in order to limit the tilting of the underframe 2 in the sagittal plane. These end of travel means 24 comprise two pairs of feet 25 which are each mounted sliding in a housing 26 fixed by any appropriate means, for example by fixing tabs, to the underframe 2, with one pair on the front side of the underframe 2 and one pair on the rear side, and each foot 25 of the same pair being in the vicinity of a respective lateral end of the underframe 2.

Each housing 26 is open at its lower end 26*a* and has a vertical aperture 26*b* which extends parallel to the longitudinal axis of the foot 25 and ends, at its upper end, in a lateral notch which is perpendicular to said longitudinal axis.

Each foot 25 has a lower end 25*a* which is slightly wider for better contact with the floor, and its upper end is provided with a stud 25*b* that extends through the aperture 26*b* and which the user can grasp to move the foot 25 upward against the action of a compression spring 27 bearing on the closed upper end 26 and on the upper end of the foot 25.

In the normal position, the foot 25 extends outside the housing 26 under the action of the biasing from the spring 27, the stud 25*b* stopping the downward translation of the foot 25 by contact against the lower end of the aperture 26*b*. The lower end 25*a* of the foot 25 can then come into contact with the floor and prevent greater pivoting of the underframe 2.

In the embodiment illustrated in FIG. 6, the foot 25 and the aperture 26 are sized so that the foot 25 immediately comes into contact with the floor when the underframe 2 is vertical. In other words, the means 24 here prevent any tilting of the underframe 2. The means 24 thus make it possible to convert the tilting seat device into a non-tiltable device.

When the user wishes to be able to tilt the underframe 2 again, he needs only raise the feet 25 using the studs 25*b*, then rotate the feet 25 to place the studs 25*b* in the corresponding notches, thereby preventing the feet 25 from being lowered again.

It will be emphasized here that it would be possible to provide the lower end 25*a* of each foot 25 with a caster, such that the seat device 1 could be converted from a tilting underframe device to an underframe device with casters, allowing the user to move more easily on the floor.

It will also be emphasized here that it would be possible to size the foot 25 and the aperture 26 so that the foot 25 does not immediately come into contact with the floor, so as to allow at least slight tilting of the underframe 2.

In a variant, the height of the feet 25 could be adjustable with respect to housings 26, for example by a system of the tightening screw type similar to what may be found for height-adjustable umbrella stands. In this way, the user can adjust the distance over which the feet 25 protrude from the housings 26, and therefore the maximum angle at which the underframe 2 can be tilted toward the front or the rear.

The principles at the base of the present invention have been schematically illustrated in FIGS. 3 to 6. A more specific embodiment will now be described with respect to the structure of the various parts, with reference to FIGS. 7A to 21D.

The manner in which the saddle 5 can be made will first be described, with reference to FIGS. 7A to 8E.

In general, the saddle 5 according to the present invention comprises a front region, which is intended to support the thighs, directly above the axes of the coxofemoral joints, and a rear region which is hollowed out in a medial zone where the ischiums will be located, so as to avoid bearing on the latter, and which rises up in its two lateral zones, so as to slightly surround the inferolateral portions of the buttock of the user. Such a configuration of the saddle 5 makes it possible to wedge the pelvis B without direct bearing, thus preserving the freedom of orientation and the motility of the sacrum S and of the pelvis B. The legs are not supported.

The saddle 5 here is made of two separate portions 50 which are symmetrical relative to a vertical plane to which the depth direction of the seat 3 belongs. Each portion 50 comprises a first region 51 and a second region 52. The first two regions 51 of the two portions 50 together form the front region of the saddle 5 mentioned above. Each region 52 extends toward the rear from the posterior and lateral side of the first region 51, each second region 52 forming one of said lateral zones of the rear region of the saddle 5 mentioned above. It can also be emphasized here that the edge zone 51*a*, on the plane of symmetry side, of each first region 51 rises, while the posterior 52*a* and lateral 52*b* edges of each second region 52 also rise.

The two portions 50 of the saddle 5 could each be fixed directly to the seat 3. However, as illustrated in the Figures, the portions 50 are mounted so as to allow an adjustment of their separation and optionally of their orientation so as to adapt as finely as possible to the morphology of the user.

In particular, each portion 50 here is formed by a saddle padding 500 and a plate 501 on which it is fixed. The saddle padding 500 has a shape corresponding to the above description and is made from a flexible, resilient and comfortable material. The plate 501 is made from a rigid material and two threaded holes open onto the lower face of the plate 501, in each of which a screw is received which allows the attachment of a connection member 502.

As better shown in FIG. 7E, each connection member 502 assumes the form of a flat, elongated bar made from a rigid material, in which are arranged a first longitudinal aperture 502*a* starting from one end of the bar and ending before the other end, a second aperture 502*b* near said other end and following an arc of circle whose center is embodied by a through hole 502*c*, which is therefore located between the first and second apertures 502*a*, 502*b*. A screw passes through the through hole 502*c* and is screwed into a corresponding hole of the plate 501, while another screw passes through the second aperture 502*b* and is screwed to the other hole of the plate 501.

As can be better seen in FIG. 8A, a rack 502*d* is provided on one of the two longitudinal walls of the first aperture 502*a*, such that when the connection members 502 are placed one above the other, their first apertures 502*a* are opposite and define an opening in which a gear 502*f* is mounted, the two racks 502*d* being on different sides such that the gear 502*f* meshes with the two racks 502*d*.

The two connection members 502 are supported by a linking member 503 comprising a first receiving region 503*a* having a first slot in which the connection members 502 are received so as to be able to slide along the longitudinal direction, first receiving region 503*a* from which two branches 503*b* extend which are parallel to one another and each of which is provided at its free end with a through hole 503*c*, offset heightwise relative to the first receiving region 503*a*, for the mounting of a pivot 504 which constitutes the saddle axis.

A through hole is provided in the first receiving region 503*a*, for the passage of a rod of a thumb wheel 505, rod which will be secured to the gear 502*f*, such that a manual rotation of the thumb wheel 505 by the user will cause the gear 502*f* to rotate.

Lastly, a spring 506 is mounted on the pivot 504.

In FIG. 8B, the two portions 50 of the saddle 5 are in the maximally close/non-oriented position. By rotating the thumb wheel 505 in a first position, the user can separate the connection members 502 from one another and thus separate the two portions 50 without modifying their orientation, as can be seen in FIG. 8C showing the portions 50 in an intermediate (non-maximal) separated/non-oriented position.

Independently of the separation between the two portions 50, the user can also loosen the screws extending in the second apertures 502*b*, then pivot each portion 50 about the pivot axis constituted by the screw passing through the through hole 502*c*, the pivoting being guided by the movement of the other screw in the second aperture 502*b*. The portions 50 can thus be oriented more toward the center, as illustrated in FIG. 8D, or be oriented more toward the outside, as illustrated in FIG. 8E.

The user can thus adjust the separation and the orientation of the portions 50 of the saddle 5 to conform optimally to his morphology.

It will now be described how such a saddle 5 can be connected pivotably to the seat 3, in other words an example structure for the pivot link 7, with reference to FIGS. 9A to 11D.

The seat 3 here is formed by a seat body 30 assuming the form of a tubular part with rectangular cross-section, open at both of its longitudinal ends, and in which an opening 30*a* is provided in the upper face, starting from the end on the front side of the seat 3.

In each of the two vertical side walls 30*b* of the seat body 3 are provided, starting from the rear side of the seat 3 (on the left looking at FIGS. 9A to 9F), a first through hole 30*c*, a series of second through holes 30*d* in the vicinity of one another and stopping before the beginning of the opening 30*a*, a third through hole 30*e*, at the front end, and a series of fourth through holes 30*f* positioned near one another, above the third hole 30*e* and following an arc of circle whose center is the third hole 30*e*.

Each of the two ends of the pivot 504 is mounted rotating in a corresponding third hole 30*e*, the linking means for linking the two portions 50 to one another being received in the seat body 30 owing to the opening 30*a*. The saddle 5 can thus pivot relative to the seat body 30. Furthermore, a branch of the spring 506 then bears on the bottom, such that the spring 506, which constitutes elastic biasing means, can exert an elastic biasing in the clockwise direction.

A rod 33 can be inserted into a fourth hole 30*f* of a wall 30*b* until it passes through the corresponding fourth hole 30*f* in the other wall 30*b*, the rod 33 then extending through the inside of the seat body 30 so as to form a stop for the pivoting of the saddle 5. It is thus possible to define the incline at which the saddle 5 will stop when no one is seated on it.

In FIGS. 10A and 11A, the pivoting is maximal, the rod 33 being placed in the furthest forward fourth holes 30*f*, in FIGS. 10B and 11B the pivoting is intermediate, and in FIGS. 10C and 11C the pivoting is minimal, here nil, the saddle 5 being kept pressed against the seat body 30.

It will now be described how the backrest 4, and in particular the lumbar part 42, can be adjusted in terms of height and depth relative to the seat body 30, with reference to FIGS. 12A to 14B.

The backrest 4 comprises a thin vertical rod 40 that becomes wider at its upper end region 41 in order to carry the lumbar part 42.

The backrest 4 is connected to the seat body 30 by a linking part 43 which has a first, curved portion 43*a*, the upper end 43*b* of which is open, an aperture 43*c* being provided in the outer face of the first portion 43*c* and opposite the upper end 43*b*, such that the vertical rod 40 can be inserted into the upper end 43*b* and come out the other side through the aperture 43*c*.

The height of the lumbar part 42 can thus be adjusted by sliding the rod 40 vertically in the linking part 43, the backrest 4 being kept in the desired position by tightening a thumb wheel 44 which passes through a through hole 43*d*, provided to that end in said outer face of the linking part 43, and which bears on the vertical rod 40 and clamps it against the linking part 43.

The user can thus position the lumbar part 42 so that it can bear against his back at the lumbar vertebrae.

The linking part 43 has, in the extension of the first portion 43*a*, a second portion 43*e* which is formed by an upper region 43*f* and a lower region 43*g*, both of the plate type, parallel to and opposite one another. A rack 43*h* is provided on the face of the upper region 43*f* which is opposite the lower region 43*g*. The upper and lower regions 43*f*, 43*g* are spaced apart from one another so as to be able to extend into the seat body 30, while passing through the rear end of the latter, and to allow a cogwheel shaft 45 to extend between them and to mesh with the rack 43*h*. Thus, once the second portion 43*e* has been introduced into the seat body 30, the shaft 45 is introduced into the first holes 30*c*, as shown in FIGS. 13A and 13B.

The shaft 45 here is provided with a button at each of its two ends, protruding relative to the seat body 30, such that a rotation of the shaft 45 causes, by meshing of the rack 43*h*, sliding of the second portion 43*e* in the seat body 30. The user can thus adjust the backrest 4 to a minimum depth, like in FIG. 14A, or to an intermediate depth, like in FIG. 14B, in which figures a side wall 30*b* of the seat body 30 has been omitted.

FIGS. 15A to 15D show the seat 3/backrest 4/saddle 5 assembly.

It will now be described how this assembly can be pivotably connected to the underframe 2, in other words an example structure for the pivot link 6, with reference to FIGS. 16A to 19B.

It can first be emphasized that the underframe 2 here is an underframe of the tilting type able to be provided with nesting wedges to allow an adjustment of the height of the seat 3/backrest 4/saddle 5 assembly, so as to obtain the ideal curve radius as a function of the user's size. Thus, the underframe 2 has means making it possible to nest a wedge 9 there which follows the same curve as the lower portion 23, this wedge 9 also having means making it possible to nest another wedge 9 there which follows the same curve. The height adjustment is thus obtained by nesting one or several wedges 9. Of course, each wedge 9 will follow a curve whose curve radius is different from that of the other wedges 9. The means for nesting a wedge will for example be able to be clips, nesting male lugs in female receptacles, screwing, etc.

The underframe 2 comprises a U-shaped support 28, the two wings 28*a* of which are triangular and taper upward, and a foot 28*b* (FIGS. 17A to 17C) extends downward from the bottom 28*c* of the support 28 to be received slidingly, so that its height is adjustable, in a cylindrical housing 20*a* carried at the upper end of a base 20 forming the underframe portion strictly speaking. The rotation of the foot 28*b* relative to the housing 20*a*, and therefore of the support 28 relative to the base 20, can be free or locked by any appropriate means. Advantageously, the height adjustment travel of the foot 28*b* is equal to the height of a wedge 9, so as to offer the user the ability to adjust the seat 3 to any height in the full range of heights procured by the wedges 9 and the foot 28*b*.

Each wing 28*a* has a through hole 28*d* (FIG. 18C) opposite that of the other wing 28*a*, for mounting a pivot 28*e* which will in turn extend through a second through hole 30*d* of the seat body 30, such that the seat body 30 can pivot relative to the support 28.

Each wing 28*a* further has, along each of its two inclined edges, an elongated aperture 28*f* serving to receive a stop bolt 28*g*. Thus, two stop bolts 28*g* extend through the support 28 so as to constitute, for one, a stop for the pivoting of the seat body 30 toward the rear, and for the other, a stop for the pivoting toward the front.

The user can thus define the positions for the end of pivoting travel for the seat 3/backrest 4/saddle 5 assembly, simply by loosening the nut of a stop bolt 28*g*, sliding the screw of the stop bolt 28*g* along the apertures 28*f*, then retightening the nut so as to immobilize the stop bolt 28*g*.

The user can for example choose to limit the forward pivoting more significantly than the backward pivoting, like in FIG. 17B, or provide a same maximum tilt angle toward the front and toward the rear, like in FIG. 17C.

It will now be described how the seat 3/backrest 4/saddle 5 assembly is biased elastically in the counterclockwise rotation direction by the elastic biasing means 29, here a spring part 29, with reference to FIGS. 18A to 19B.

The spring part 29 is a torsion spring formed by a metal wire which, in a first end region 29*a*, is wound in turns, in a central region 29*b* is bent so as to form a front U, in a second end region 29*c*, to be wound again in turns coaxial to those of the first end region 29*a*. In particular, the central region 29*b* is formed by a rod portion which is parallel to the axis of the turns but offset therefrom, the spring part 29 being U-shaped.

A mounting branch 29*e* extends outward from each end region 29*a*, 29*c*, in order to mount the spring part 29 on the support 28, as illustrated in FIGS. 18C and 18D. In particular, a series of through holes 28*h* will have been provided near one another and along an arc of circle centered on the through hole 28*d* in which the pivot 28*e* is mounted, each mounting branch 29*e* being able to be mounted selectively in one of the holes 28*h*. Once the spring part 29 is mounted in the support 28, the central region 29*b* is located on the front side of the seat 3 relative to the through hole 28*d*.

Referring now to FIGS. 19A and 19B, it is shown that when the seat body 30 is mounted pivoting on the support 28 about the pivot 28*e*, the central region 29*b* surrounds the lower outer portion of the seat body 30, the spring part 29 being dimensioned for this purpose. Thus, the central region 29*b* bears against the lower face of the seat body 30 and will elastically bias the latter so that it pivots about the pivot 28*e* in the counterclockwise direction.

The user can adjust the magnitude of this elastic biasing by modifying the positioning of the mounting branches 29*e* in the holes 28*h*.

FIGS. 20A to 20D show the seat device incorporating the structures as described in connection with FIGS. 7A to 19B.

Because the support 28 is able to pivot relative to the base 20, and then is locked in position using any appropriate means, the user will be able to orient the base 20 relative to the support 28 so that the underframe 2 is of the type tilting in the sagittal plane, as illustrated in FIGS. 20A and 20B, or of the type tilting in the transverse plane, as illustrated in FIGS. 20C and 20D.

Furthermore, the user is able to adjust the position of the lumbar part 42 so that it comes into contact with the back both with adequate force and in the adequate position.

The modification of the force applied by the lumbar part 42 on the user's back depends on the rotational torque in the clockwise direction applied on the seat 3 by the weight of the user. A first simple solution consists of adjusting the magnitude of the elastic biasing exerted by the means for elastically biasing the seat 3 in counterclockwise rotation. The greater the magnitude of the elastic biasing is, the smaller the resultant of the elastic biasing and the rotational torque applied by the user on the seat 3 is, and therefore the lower the force applied by the lumbar part 42 against the user's back will be. In the case where these elastic biasing means are formed by a spring, it suffices to modify the stiffness of the spring, for example by replacing it with another spring, or more simply, by adjusting the spring as described above.

This adjustment can also be obtained by adjusting the distance between the seat axis A1 and the saddle axis A2, as is possible in the particular embodiment described above.

In FIG. 17A, the pivot 28*e* has been placed in the fourth of the second through holes 30*d* of the seat body 30, starting from the left. The action of the weight of the seat 3 occurs along the vertical line tangent to the 3$^{rd}$ lumbar vertebra Lb, as illustrated in FIG. 4D. In this position, the pivot 28*e*, and therefore the seat axis A1, is relatively close to the pivot 504 (saddle axis A2).

If the pivot 28*e* is removed and is placed in the first of the two through holes 30*d*, starting from the left, the distance between the pivot 28*e* and the pivot 504 is greater, and the position of the action of the weight remains unchanged because the user stays on the saddle 5, the position of which relative to the seat 3 does not change. Thus, the lever arm between the action of the weight and the pivot 28*e* is greater, and therefore the rotational torque exerted by the user on the seat 3 is greater.

FIGS. 3 to 20D show in detail and, to a sufficient extent for the understanding and the implementation of the invention, schematically, one particular embodiment of the seat device according to the present invention. Referring now to FIGS. 21 to 31, a variant embodiment is shown which incorporates the functional means described above into a design procuring an exterior aspect which can be qualified as more modern.

Referring first to FIGS. 21 and 22, the seat device 1' according to this variant comprises an underframe 2', a seat 3', a backrest 4', a lumbar part 42' and a saddle 5'.

As shown in FIGS. 30 and 31, the underframe 2' is of the tilting type and is remarkable, compared to those described above, in that it comprises a U-shaped part 20' whereof the two lateral arms 21' are curved, in an arc of circle, and in contact with the floor, and in that on the lower face of each lateral arm 21' is provided a straight tongue 22', one end of which is fixed, by any appropriate means, for example by screws, to the lower face of the respective lateral arm 21', in the region close to the base of the U shape of the part 20, the rest of the tongue 22' not being secured to said lateral arm 21' and extending freely up to the free end of said lateral arm 21', while being globally horizontal at rest, that is to say when the seat device 1' is not biased by a user, where the seat 3' is substantially horizontal. FIG. 26 shows the underframe 2' in this resting position. The end of the tongue 22' is at a distance from the free end of the lateral arm 21' and the tongue 22' is made from a flexible material having elastic properties, such that in the case where the seat device 1' is in a position tilted toward the rear and the user leaves the seat device 1', the tongues 22', bearing on the floor by their free end regions, return, due to their elasticity, the underframe 2' to this resting position.

Referring now to FIG. 23, the lumbar part 42' is also adjustable in terms of height, on the same principle of sliding an upper portion bearing the length part 42' in a lower portion connected or secured to the seat, with maintenance in position by a thumb wheel 40', here provided on the side.

It is emphasized here that the lumbar part 42' here is advantageously a roller 420' mounted rotating freely about its axis while being carried, at each of its ends, by two vertical arms 421' defining a fork shape through which the roller 420' extends.

Still in reference to FIG. 23, the depth of the backrest 4' can also be adjusted, on the same principle of translation, relative to the seat 3', by a rack 43' and cog 44' system, the rotation of the latter being controlled by a lateral thumb wheel 45' (FIG. 21), the backrest 4' thus being able to be moved closer to or further from the saddle 5' as illustrated by the two pairs of arrows.

In reference now to FIG. 24, the saddle 5' here again is made in two separate portions 50' which are symmetrical relative to a vertical plane to which the depth direction of the seat 3' belongs, and the separation between these two portions 50' is also adjustable, the parts associated with this adjustment are received in a casing assembly 51' which is more pleasing to the eye.

In particular, one portion 50' of the saddle 5' is carried by a first bent support 52', and the other portion 50' is carried by a second support 52'. FIG. 25 shows the first support 52' and FIG. 26 shows the second support 52'. These figures, as well as FIGS. 27 and 28, show that each support 52' comprises a first casing portion 520', which is also bent. The first support 52' comprises a first horizontal bar 521' extending outside the first casing portion 520'. The first bar 521' has, on its upper side, a first rabbet 522', pushed from its free end into the vicinity of the inlet of the first casing portion 520', where it ends in a second, more narrow rabbet 523'. The first rabbet 522' here is interrupted by a through opening 524' in which a block will be fixed carrying a rack, on the inner side. The second support 52' has a similar shape, with the difference that the first and second rabbets 522' and 523' are located on the lower side of the second bar 521' and along the opposite longitudinal edge thereof. As can be better seen in FIG. 29, the heights of the first and second bars 521' are such that in the assembled position, the second bar 521' extends above the first bar 521' and a central space 525' is laterally delimited by the first two rabbets 522' opposite one another, including the two blocks carrying the racks in the openings 524', and vertically by the upper and lower sides, respectively, of the first and the second bar 521'. A gear 526' is received in the central space 524' and is engaged with the two racks, and a vertical guide shaft (not shown) passes through the center of the gear 526' and extends, below and above, in a longitudinal aperture 527' provided to that end respectively in the first bar 521' and the second bar 521'. Of course, it can be provided that the first rabbets 522' are free of openings serving to receive the blocks bearing the racks, and that the racks are directly formed on the vertical faces, on the inner side, of the first two rabbets 522'.

The casing assembly 51' is formed by the first casing portions 52', by an upper cover 53' and a lower cover 54' (FIG. 24). The covers 53' and 54' are globally semicylindrical, each with an opening 531', 541' in their side wall which extends over a portion of the circumference, the two openings 531' and 541' communicating with one another and defining a space in which a blocking handle 55' is located which is mounted pivoting about an axis parallel to the pivot axis A2 of the saddle 5', by means of pivots (not shown) each mounted partially in a lateral hole 550' (FIG. 27) of the handle 55' and partially in a corresponding hole provided in the upper cover 53' (not shown). The handle 55' in particular comprises a protrusion 551' which extends through an opening provided in a first cylindrical intermediate part 56' surrounded by the covers 53' and 54', and through an opening provided in a second intermediate part 57' which is partially surrounded by the first intermediate part 56' and in turn surrounding the first and second bars 521'.

The various parts described above are dimensioned so that, in a first so-called blocking position, shown in FIGS. 27 and 28, the protrusion 551' bears on the second bar 521' of the second support 2' such that clamping of the bars 521' against one another is obtained, preventing any relative movement between the first and second supports 52'. In the blocking position, the rest of the handle 55' is advantageously flush with the outer surface of the upper cover 53' (FIG. 24). In a second so-called released position, the handle 55' has been pivoted upward, which results in releasing the bearing exerted by the protrusion 551' on the second bar 521', to such an extent that a relative translation between the first and second supports 52' is allowed, in the direction parallel to the pivot axis A2 of the saddle 5'. This translation is done directly by the user, pulling or pushing the supports 52', which will slide inside the upper 53' and lower 54' covers. The presence of the gear 526' and of the two racks makes it possible to preserve a mirror movement of the two portions 50', that is to say a movement of the latter which is symmetrical relative to a median vertical plane to which the depth direction of the seat 3' belongs.

The means described above therefore constitute means for adjusting the separation of the two saddle portions 50'.

Referring again to FIGS. 27 and 28, it is shown that the means for biasing the saddle 5' in forward rotation comprise two torsion springs 58', one on each side of the handle 55', which surround the first intermediate part 56' while being received in grooves 580' provided to that end in the upper covers 53' and 54' (grooves visible only for the lower cover 54'). A first branch of each spring 58' is fixed to the upper cover 53', which in turn is fixed in position, since it is fixed by any appropriate means to the seat 3', and a second branch of each spring 58' is secured to the end supports 52', in particular by means of the first and second intermediate parts 56' and 57' to which the second branch is fixed, for example by being received in radial holes provided to that end. The springs 58' are configured to bias the saddle 5' in forward rotation.

In reference lastly to FIG. 29, means are shown for elastically biasing the seat 3' toward the rear, which cooperate with means for adjusting the magnitude of the elastic biasing thereof. These elastic biasing means are two traction springs 30' which are positioned vertically, the lower ends of which are fixed to a bar 31' secured to the underframe 2' and the upper ends of which are fixed to a slide 32' positioned inside a U-shaped part 33' forming a portion of the seat 3', so as to be able to slide perpendicularly to the bottom of the U-shaped part 33'. The slide 32' is provided, at its center, with a threaded hole 34' in which a threaded rod 35' is received which extends to the outside of the U-shaped part 33', where it is fixed to a thumb wheel 36' allowing the user to rotate the threaded rod 35'. It will easily be understood that a rotation of the threaded rod 35' in one direction will cause a translation of the slide 32' in a first direction, for example corresponding to an elongation of the springs 30', and therefore an increase in the magnitude of the biasing that they exert on the seat 3', and that a rotation in the opposite direction will cause a translation of the slide 32' in the opposite direction, reducing the elongation of the springs 30', for example to the position illustrated in FIG. 29 in which this elongation is nil, and therefore a reduction in the magnitude of said biasing. The slide 32', the threaded rod 35' and the thumb wheel 36' therefore constitute said adjusting means. It is emphasized that the above configuration of said adjusting means and of the elastic biasing means indeed allows the seat 3' to pivot relative to the underframe 2, the pivoting leading to flexion of the springs 30'.

It is understood that the particular embodiment that has been described above was given for information and non-limitingly, and that changes can be made thereto without departing from the scope of the present invention.

The invention claimed is:

1. A seat device comprising an underframe and a seat comprising:

a rear region and a front region, wherein the seat is pivotally connected to the underframe by a first pivot link allowing the seat to pivot relative to the underframe about a pivot seat axis, wherein the pivot seat axis is horizontal and orthogonal to a depth direction of the seat, said first pivot link being positioned relative to the seat such that the seat pivots forward in a sagittal plane when a user sits on the seat device, wherein the seat device further comprises:

means for elastically biasing the seat in rotation rearward in the sagittal plane, a lumbar part that is rotationally secured to the seat and positioned such that during use, the lumbar part exerts pressure against the back of the user at the lumbar vertebrae, and a saddle configured to support at least a portion of the thighs of the user, the saddle being connected to the front region of the seat.

2. The seat device according to claim 1, wherein the saddle is pivotally connected to the front region of the seat by a second pivot link allowing the saddle to pivot relative to the seat about a pivot saddle axis, wherein the pivot saddle axis is parallel to the pivot seat axis and in front of the pivot seat axis in the depth direction of the seat, wherein the seat device further comprises means for elastically biasing the saddle in rotation forward in the sagittal plane.

3. The seat device according to claim 2, wherein each one of the first pivot link and second pivot links comprises a pivot defining respectively the pivot seat axis and the pivot saddle axis.

4. The seat device according to claim 2, wherein the seat is mounted with adjustable position relative to the underframe, so as to allow an adjustment of a distance between the pivot seat axis and the pivot saddle axis, in the depth direction of the seat.

5. The seat device according to claim 2, wherein the saddle is formed by a first portion and a second portion that are symmetrical relative to a vertical plane to which the depth direction of the seat belongs, Wherein each of the first portion and the second portion of the saddle are configured to support at least a portion of a respective thigh of the user.

6. The seat device according to claim 5, wherein the first portion and the second portion of the saddle are adjustable relative to each other to create a separation along the vertical plane.

7. The seat device according to claim 2, wherein the saddle comprises a front region configured to support at least a portion of the thighs of the user directly above an axis of coxofemoral joints of the user, and a rear region comprising a hollowed out region in a medial zone, configured to receive ischiums of the user and wherein a first lateral zone and a second lateral tone of the rear region each comprise a lip that at least partially surrounds inferolateral portions of the buttock of the user.

8. The seat device according to claim 2, further comprising stops positioned to limit pivoting of the saddle forwardly and rearwardly in the sagittal plane.

9. The seat device according to claim 2, wherein the means for elastically biasing the saddle are springs.

10. The seat device according to claim 9, wherein the springs are torsion springs with adjustable tension.

11. The seat device according to claim 1, further comprising stops positioned to limit a pivoting range of the seat forwardly and rearwardly in the sagittal plane.

12. The seat device according to claim 1, wherein the means for elastically biasing the seat are springs.

13. The seat device according to claim 12, wherein the springs comprise torsion springs with adjustable tension.

14. The seat device according to claim 1, the lumbar part is position-adjustable, relative to the pivot seat axis, in a vertical direction and in the depth direction of the seat, so as to allow the position of the lumbar part to he adjusted as a function of the build of the user.

15. The seat device according to claim 1, wherein the underframe is of the tilting type at least in the sagittal plane.

16. The seat device according to claim 15, wherein the underframe tilts in the sagittal plane and in a transverse plane.

17. The seat device according to claim 15, wherein the underframe has a rounded base having means for receiving at least one nesting wedge configured to adjust a height of the underframe, wherein the at least one nesting wedge has a substantially similar contour as a bottom side of the rounded base.

18. The seat device according to claim 15, further comprising means for defining a maximum tilting amplitude of the underframe.

19. The seat device according to claim 18, wherein the means for defining the maximum tilting amplitude of the underframe comprise feet mounted to the underframe, wherein the feet are configured to be movable between a first position in which the feet protrude relative to the underframe such as to come into contact with a floor and oppose the tilting of the underframe, and a second position in which the feet do not protrude relative to the underframe.

20. The seat device according to claim 18, wherein the underframe tilts in the sagittal plane and in a transverse plane.

* * * * *